US006199707B1

(12) United States Patent
Suzuki et al.

(10) Patent No.: US 6,199,707 B1
(45) Date of Patent: Mar. 13, 2001

(54) TELESCOPIC BOOM

(75) Inventors: Takuo Suzuki, Saitama; Tomomasa Ebara, Gunma; Makoto Nagao, Saitama; Yoichi Hayakawa; Michito Tsuriya, both of Gunma, all of (JP)

(73) Assignee: Kabushiki Kaisha Aichi Corporation, Aichi (JP)

( * ) Notice: Subject to any disclaimer, the term of this patent is extended or adjusted under 35 U.S.C. 154(b) by 0 days.

(21) Appl. No.: 09/218,661

(22) Filed: Dec. 22, 1998

(30) Foreign Application Priority Data

Apr. 23, 1998 (JP) ..... 10-113799
May 28, 1998 (JP) ..... 10-147223
Nov. 12, 1998 (JP) ..... 10-322127

(51) Int. Cl.[7] ..... B06C 23/06
(52) U.S. Cl. ..... 212/349; 414/918
(58) Field of Search ..... 212/349; 52/118; 414/918

(56) References Cited

U.S. PATENT DOCUMENTS 2,684,159 * 7/1954 Oldenkamp ..... 212/349
3,307,713 * 3/1967 Bopp ..... 212/349
3,817,007 * 6/1974 Hall ..... 52/118
4,217,987 * 8/1980 Gattu et al. ..... 52/118
5,695,082 * 12/1997 Rainwater ..... 212/349
5,718,345 * 2/1998 Hade ..... 212/349

* cited by examiner

*Primary Examiner*—Thomas J. Brahan
(74) *Attorney, Agent, or Firm*—Robert W. J. Usher

(57) ABSTRACT

A telescopic boom 9 comprises a proximal boom 9*a*, an intermediate boom 9*b*, and a distal boom 9*c* assembled together in a telescopic fashion. A telescopic cylinder 21 is disposed such that a distal end portion of a cylinder rod 21*b* is firmly attached to a proximal end portion of the proximal boom 9*a*, whereas a cylinder tube 21*a* is firmly attached into the intermediate boom 9*b*. A retraction sheave 25 is mounted to the cylinder tube 21*a* nearer the proximal end of the telescopic boom 9. An extension sheave 27 is mounted to the cylinder tube 21*a* nearer the distal end of the telescopic boom 9. A guide pipe 35 is disposed such that one end thereof is firmly attached to the proximal end portion of the proximal boom 9*a* and the other end is disposed between the retraction sheave 25 and the extension sheave 27. A protective tube 47 is disposed such that, with its one end firmly attached to the distal end portion of the guide pipe 35, it extends toward the distal end of the telescopic boom 9 and then is reversed in the vicinity of an end portion of the cylinder tube 21*a* so as to extend to a position opposing the guide pipe 35 from the cylinder tube 21*a*, with the other end connected to the proximal end portion of the distal boom 9*c*. A hose and the like 45 penetrate through the protective tube 47.

14 Claims, 20 Drawing Sheets

PRIOR ART

PRIOR ART

TELESCOPIC BOOM

FIELD OF THE INVENTION

The present invention relates to a telescopic boom incorporating therein a telescopic cylinder; and, more specifically, to a telescopic boom mounted to a vehicle for high lift work.

BACKGROUND OF THE INVENTION

Known as a vehicle for high lift work is the one comprising a turntable mounted on a body, a telescopic boom axially supported by the turntable and adapted to perform operations such as extension/retraction and derricking, and a platform attached to the distal end of the telescopic boom. At the time of operation, this vehicle can derrick and extend the telescopic boom such as to move the platform to a desirable high working position, thus allowing workers to work there.

An example of the telescopic boom for such a vehicle for high lift work, as shown in FIG. 19, is constituted, in a telescopic fashion, by a proximal boom 909*a* mounted to the body (not shown) of the vehicle so as to be able to derrick, an intermediate boom 909*b* inserted into the proximal boom 909*a* so as to be able to extend and retract therein, and a distal boom 909*c* inserted into the intermediate boom 909*b* so as to be able to extend and retract therein. Thus constituted telescopic boom 909 incorporates therein a telescopic cylinder 921 which drives the intermediate boom 909*b* so as to make it extend or retract relative to the proximal boom 909*a*. The distal end portion of the cylinder rod 921*b* of the telescopic cylinder 921 is attached to the inside of the proximal end portion of the proximal boom 909*a*; whereas a cylinder tube 921*a* is attached, by way of a stationary shaft 923 extending laterally therefrom, to the inside of the proximal end portion of the intermediate boom 909*b*.

At positions separated from the cylinder tube 921*a* by a predetermined distance, the stationary shaft 923 is provided with rotatable retraction sheaves 925, each of which is wound with a retraction wire 935, whose one end is fixedly attached to the inside of the proximal end portion of the distal boom 909*c*, whereas the other end is fixedly attached to the inside of the distal end portion of the proximal boom 909*a*. The distal end of the cylinder tube 921*a* is provided with two rotatable extension sheaves 927, which are located on the inner side than the retraction sheaves 925. Each extension sheave 927 is wound with an extension wire 937, whose one end is fixedly attached to the inside of the proximal end portion of the proximal boom 909*a*, whereas the other end is fixedly attached to the inside of the proximal end portion of the distal boom 909*c*.

Here, since one end of the retraction wire wound about each retraction sheave is connected to the distal boom, the one end extends obliquely with respect to the retraction sheave. Therefore, the thrust load caused by the retraction wires would act on the retraction sheaves, whereby there is a possibility of the retraction wires shortening their lives. A similar problem would also occur in the extension wires.

Also, the extension sheaves are disposed on the inner side than the retraction sheaves, and the extension wires wound about the respective extension sheaves extend over the upper side of the telescopic cylinder, such that one end of each extension wire is fixedly attached to the inside of the proximal end portion of the proximal boom. Therefore, when assembling the telescopic boom, the retraction wires and extension wires must temporarily be fixed separately from each other while being assembled, whereby a large amount of labor is necessary for the assembling operation of the telescopic boom, and it is difficult to adjust tensions of retraction wires and extension wires.

Further, in order to attain safety in operations by securing electric insulation between the platform and the body of the vehicle, the distal boom is formed with an insulating member. Since the extracting/retracting operation is effected such that the extension/retraction of the intermediate boom relative to the proximal boom and the extension/retraction of the distal boom relative to the intermediate boom are simultaneously performed with the same ratio, however, the telescopic boom as a whole must be elongated in order to secure an insulating distance (the amount of extension of the distal boom) which is required for the safe operation. As a consequence, there has been a problem that, depending on the installation conditions of the telescopic boom and vehicle, there is a possibility of workers on the platform receiving an electric shock when touching an electric wire or the like before securing the required insulating distance.

The distal end of the distal boom 909*c* is provided with a not-illustrated platform, which is equipped with a winch operable in response to a hydraulic pressure supplied thereto, an operating apparatus sending out a control signal to the vehicle in response to an electric power supplied thereto, and the like. Therefore, hydraulic hoses and electric cables (hereinafter referred to as "hose and the like") for connecting the body of the vehicle and the platform to each other are disposed within the telescopic boom 909. As shown in FIG. 20, the hose and the like 965, with their one end being held on the upper face of the proximal end portion of the proximal boom 909*a*, extend toward the distal end of the telescopic boom 909 along the upper face of the proximal boom 909*a*. The hose and the like 965 are wound about a sheave 961 attached to the distal end portion of the distal boom 909*a* so as to turn around toward the proximal end, pass through the gap between the proximal boom 909*a* and the intermediate boom 909*b* so as to extend to the proximal end portion of the intermediate boom 909*b*, and are wound about a hose sheave 963 attached to the proximal end portion of the intermediate boom 909*b* so as to turn around toward the distal end again. The distal end portion of the hose and the like 965 passes through the distal boom 909*c* so as to extend to the distal end of the latter. As being thus routed, the hose and the like 965 can extend or retract together with the extending/retracting operation of the telescopic boom 909.

Here, the hose sheave necessitates a hose separator for winding the hose and the like appropriately about the hose sheave such that they are separated from each other without becoming entangled, a stopper for keeping the hose and the like from dropping out of the hose sheave, and the like. Also, along with the extending/retracting operation of the telescopic boom, a repetitive motion of tension or flexure acts on the hose and the like, whereby there may be cases where the hose and the like repeatedly come into contact with the hose separator or the like, thus being worn out or damaged. Also, when an excess tension is applied to an electric cable, there is a possibility of its inner strands breaking. Further, there is a problem that, when the extension wire wound about an extension sheave is broken or drops out thereof, there is a possibility of the distal boom moving down toward the proximal end of the telescopic boom.

SUMMARY OF THE INVENTION

In view of such problems, it is a principal object of the present invention to provide a telescopic boom which is easy to assemble.

It is another object of the present invention to provide a telescopic boom in which tensions of its retraction and extension wires are easy to adjust.

It is a further object of the present invention to provide a telescopic boom which can keep the lives of the retraction and extension wires from decreasing.

It is another object of the present invention to provide a telescopic boom which can secure the electric insulation thereof and thus is excellent in safety.

It is a further object of the present invention to provide a telescopic boom in which, even when an extension wire is broken, for example, there is no possibility of its distal boom moving down toward the proximal end of the telescopic boom.

It is another object of the present invention to provide a telescopic boom which does not necessitate any auxiliary component for keeping the hose and the like from dropping out of their hose sheave.

The telescopic boom in accordance with the present invention comprises a first boom, a second boom inserted into the first boom so as to be able to extend and retract therein, and a third boom inserted into the second boom so as to be able to extend and retract therein, which are assembled together in a telescopic fashion. The telescopic boom further comprises a telescopic cylinder, adapted to plunge into and out of said third boom, having a cylinder rod with a distal end portion fixedly attached to an inner proximal end portion of the first boom and a cylinder body fixedly attached to an inner proximal end portion of the second boom; a retraction sheave disposed aside of the telescopic cylinder nearer a proximal end portion thereof; an extension sheave disposed aside of the telescopic cylinder nearer a distal end portion thereof; a rod member, disposed on an upper or lower side of the telescopic cylinder, having one end fixedly attached to a proximal end portion of the first boom and the other end extending between the retraction sheave and the extension sheave; a retraction wire, wound about the retraction sheave, having one end fixedly attached to a distal end portion of the rod member and the other end fixedly attached to a proximal end portion of the third boom; and an extension wire, wound about the extension sheave, having one end fixedly attached to the distal end portion of the rod member and the other end fixedly attached to the proximal end portion of the third boom.

When the telescopic cylinder is operated so as to extend from the totally retracted state of the telescopic boom, then the second boom extends relative to the first boom. Simultaneously therewith, since the extension sheave mounted to the telescopic cylinder is wound with the extension wire, the third boom is pulled up as the extension sheave ascends. Namely, as the telescopic cylinder is extended, the telescopic boom as a whole simultaneously extends at the same ratio. When the telescopic cylinder is operated so as to retract, on the other hand, then the second boom retracts relative to the first boom. Simultaneously therewith, since the retraction sheave mounted to the telescopic cylinder is wound with the retraction wire, the third boom is pulled back as the retraction sheave descends. Namely, as the telescopic cylinder is retracted, the telescopic boom as a whole simultaneously retracts at the same ratio.

Further scope of applicability of the present invention will come apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention wherein.

DESCRIPTION OF THE PREFERRED EMBODIMENTS

First Embodiment

Figure 1:
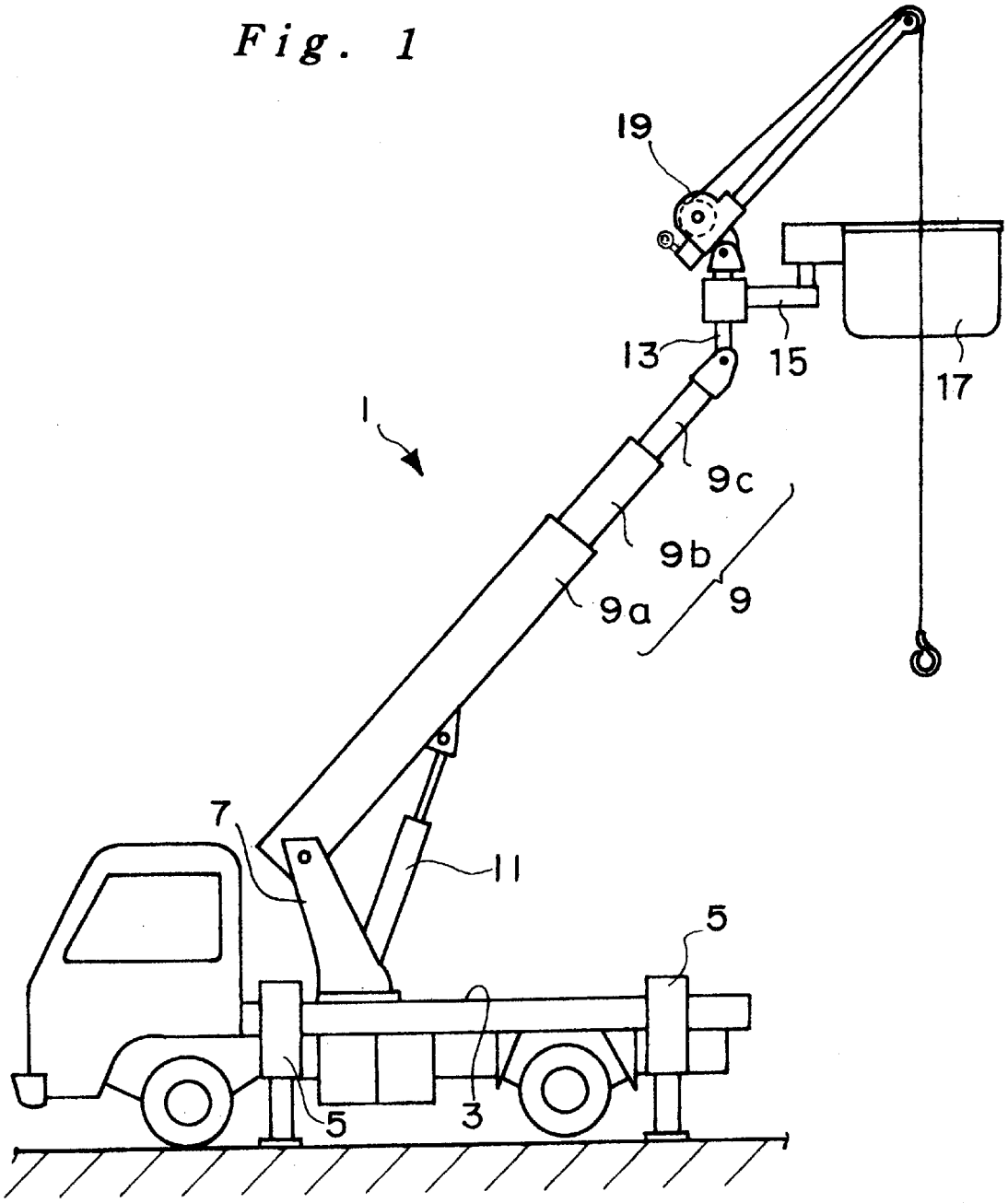
FIG. 1 is a front view of a vehicle for high lift work having a telescopic boom in accordance with the present invention.
Figure 4:
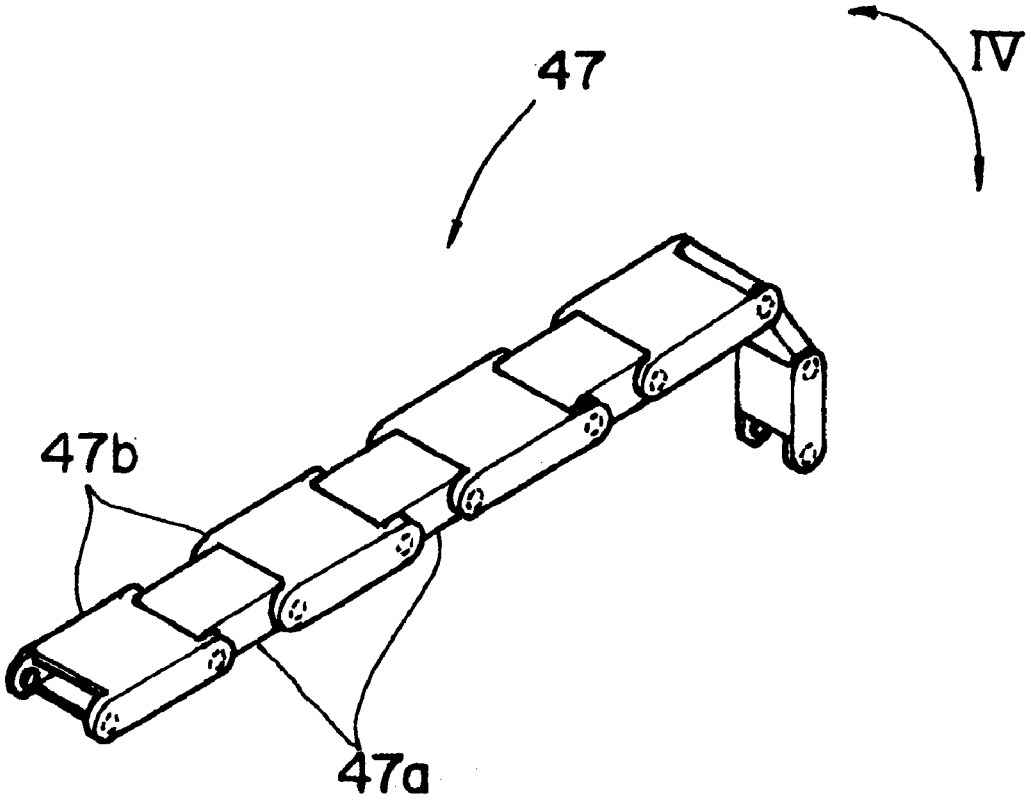
FIG. 4 is a perspective view showing a protective tube in the telescopic boom in accordance with the first embodiment.

The first embodiment of the present invention will be explained with reference to FIGS. 1 and 4. FIG. 1 shows a vehicle for high lift work equipped with the telescopic boom in accordance with the first embodiment of the present invention. This vehicle 1 has four outrigger jacks 5, disposed at their respective positions on the right and left sides in the front and rear of the body 3, for supporting the body; and a turntable 7 disposed on the body 3 so as to be able to turn around with the aid of a hydraulic motor (not shown). On the upper part of the turntable 7, a proximal end portion of a telescopic boom 9 is axially supported so as to be able to derrick. The telescopic boom 9 is derricked upon extending/retracting operations of a boom-derricking cylinder 11 disposed between the turntable 7 and the telescopic boom 9.

The distal end of the telescopic boom 9 is provided with a vertical post 13, which is always kept vertical by a leveling cylinder (not shown) adapted to extend/retract in response to the derricking angle of the telescopic boom 9. The vertical post 13 is provided with a swivel arm 15, which is able to horizontally swivel relative to the vertical post 13 with the aid of a hydraulic motor which is not shown. A distal end portion of the swivel arm 15 is provided with a platform 17. The vertical post 13 is equipped with a winch device 19 for lifting objects to be worked and the like.

Figure 2:
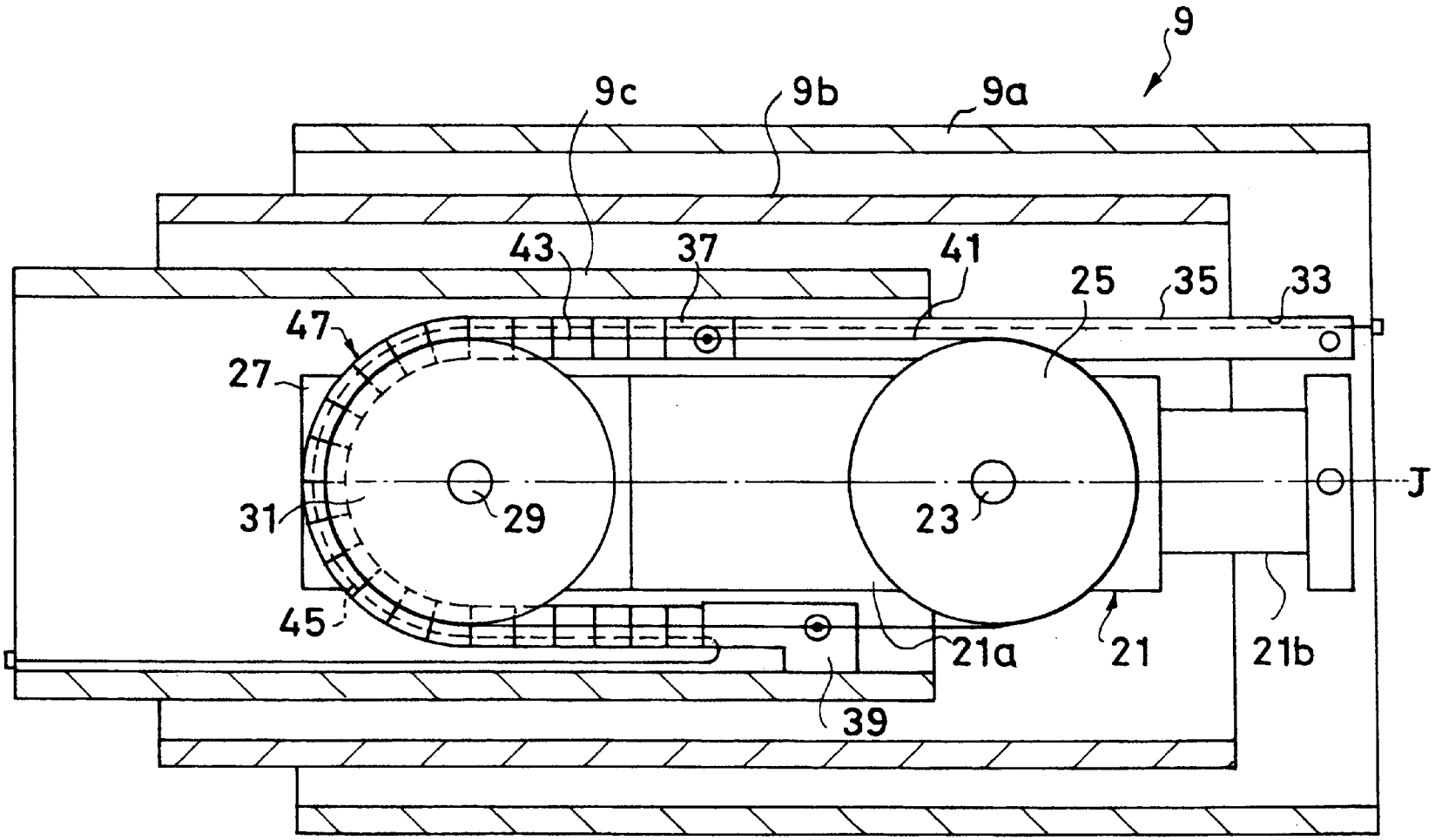
FIG. 2 is a sectional front view of the telescopic boom in accordance with a first embodiment of the present invention.
Figure 3:
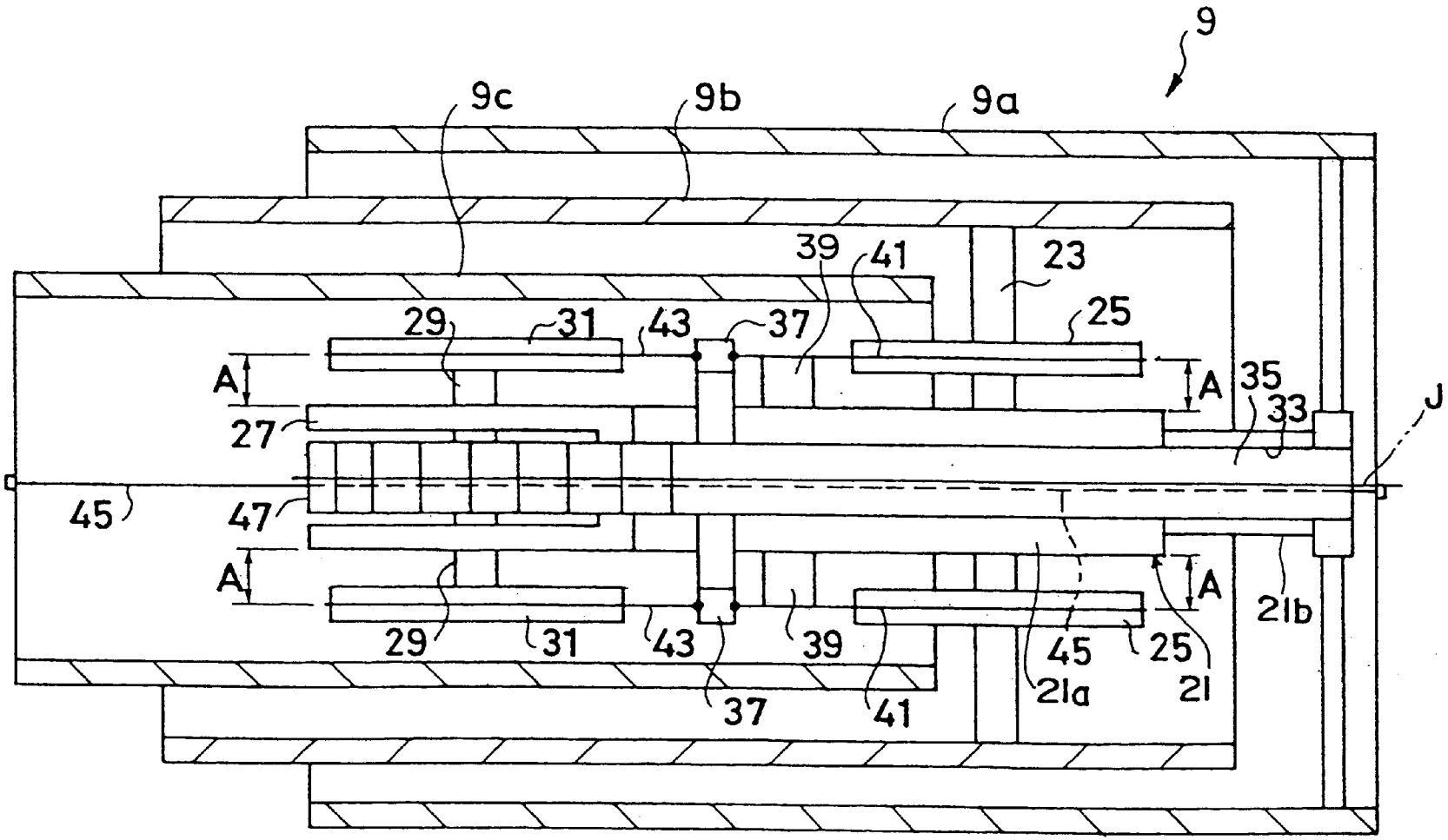
FIG. 3 is a sectional plan view of the telescopic boom in accordance with the first embodiment.

As shown in FIGS. 2 and 3, the telescopic boom 9 comprises three boom members constituted, successively from the outer side, by a proximal boom 9*a*, an intermediate boom 9*b*, and a distal boom 9*c*, which are able to extend and retract in a telescopic fashion. The proximal boom 9*a* and the intermediate boom 9*b* are made of a metal, whereas the distal boom 9*c* is made of an insulating member such as FRP for securing electric insulation between the platform 17 and the body 3. The telescopic boom 9 incorporates therein a telescopic cylinder 21 for driving the intermediate boom 9*b* so as to make it extend and retract relative to the proximal boom 9*a*. The telescopic cylinder 21 has a cylinder tube 21*a* and a cylinder rod 21*b*. A distal end portion of the cylinder rod 21*b* is attached to the inside of a proximal end portion of the proximal boom 9*a*, whereas the cylinder tube 21*a* is attached to the inside of a proximal end portion of the intermediate boom 9*b* via a stationary shaft 23 projecting outward from the right and left side walls thereof nearer the cylinder rod 21*b*.

A pair of right and left retraction sheaves 25 are axially supported by the stationary shaft 23 at their respective locations separated outward from the corresponding right and left side walls by a predetermined distance A. The end portion of the cylinder tube 21*a* on the distal end side of the telescopic boom 9 is provided with a protrusion 27 having an inverted U-shaped protuberant cross section. The center part of the protrusion 27 is provided with a rotary shaft 29 inserted therethrough in a direction perpendicular to the center axis J of the telescopic cylinder 21. Both end portions of the rotary shaft 29 project to their respective locations separated from their corresponding side walls of the protrusion 27 by a predetermined distance. Extension sheaves 31 are axially supported by the respective end portions of the rotary shaft 29 at locations separated outward from their corresponding side walls of the protrusion 27 by the predetermined distance A.

Above the telescopic cylinder 21, a rod-shaped guide pipe 35 having a through hole 33 extending along the direction of the axis J is disposed inside the distal boom 9*c*. The guide pipe 35 has a proximal end portion fixedly attached to the inside of the proximal end portion of the proximal boom 9*c* and a distal end portion extending between the distal boom 9*c* and the cylinder tube 21*a* and between the retraction sheaves 25 and extension sheaves 31. A distal end portion of the guide pipe 35 is provided with a first wire connecting section 37 projecting laterally rightward and leftward therefrom. Below the cylinder tube 21*a*, a second wire connecting section 39 projecting to the inside of the distal boom 9*c* is disposed at the proximal end portion of the distal boom 9*c*.

One end portion of a retraction wire 41 is connected to the first wire connecting section 37 of the guide pipe 35. The retraction wire 41 is wound about one retraction sheave 25, and the other end thereof is connected to the second wire connecting section 39. Also, one end portion of an extension wire 43 is connected to the first wire connecting section 37. The extension wire 43 is wound about one extension sheave 31, and the other end thereof is connected to the second wire connecting section 39. More specifically, the retraction wire 41 wound about one retraction sheave 25, the retraction wire 41 extending from this retraction sheave 25, the extension wire 43 wound about one extension sheave 31, and the extension wire 43 extending from this extension sheave 31 are stretched within the same plane (within a plane vertical to the paper surface of FIG. 3). As a consequence, no thrust loads from the retraction wires 41 and extension wires 43 would act on the retraction sheaves 25 and extension sheaves 31.

The telescopic cylinder 21, extension sheaves 31, retraction sheaves 25, extension wires 37, extension wires 43, retraction wires 41, guide pipe 35, and second wire connecting section 39 (hereinafter collectively referred to as "built-in assembly"), as a whole, can be inserted into and pulled out from a boom assembly comprising the proximal, intermediate, and distal booms 9*a*, 9*b*, and 9*c*. Consequently, the assembling of the telescopic boom 9, exchanging of hoses, and the like can be effected easily.

Connected to the distal end portion of the guide pipe 35 is one end portion of a flexible protective tube (hydraulic/electric feed protecting means) 47 which holds hydraulic hoses and electric cables (hereinafter collectively referred to as "hose and the like 45") for connecting the body 3 and the platform 17 to each other. The protective tube is reversed in the vicinity of the distal end portion of the protrusion 27 at a position nearer the distal end portion of the telescopic boom 9 than is the rotary axis 29, so as to extend therebelow, and the other end thereof is connected to the second wire connecting section 33. As shown in FIG. 4, the protective tube 47 is constituted by a plurality of convex parts 47*a* and concave parts 47*b*, each having a hollow rectangular section, alternately mating each other. Consequently, the protective tube 47 is able to flex/swing as indicated by arrows IV.

The hose and the like 45 are inserted into the protective tube 47, with one end thereof passing through the guide pipe 35 so as to be fixedly attached to the base part of the proximal boom 9*a*, whereas the other end extending along the inner wall face of the distal boom 9*c* and then being reversed so as to be fixedly attached to the second wire connecting section 39. As a consequence, even when the distal boom 9*c* extends/retracts upon the extending/retracting operation of the telescopic cylinder 21, since the hose and the like 45 are disposed within the protective tube 47, the hose and the like 45 would not project out of the protective tube 47 and thus would not be entangled nor fall apart.

Figure 5:
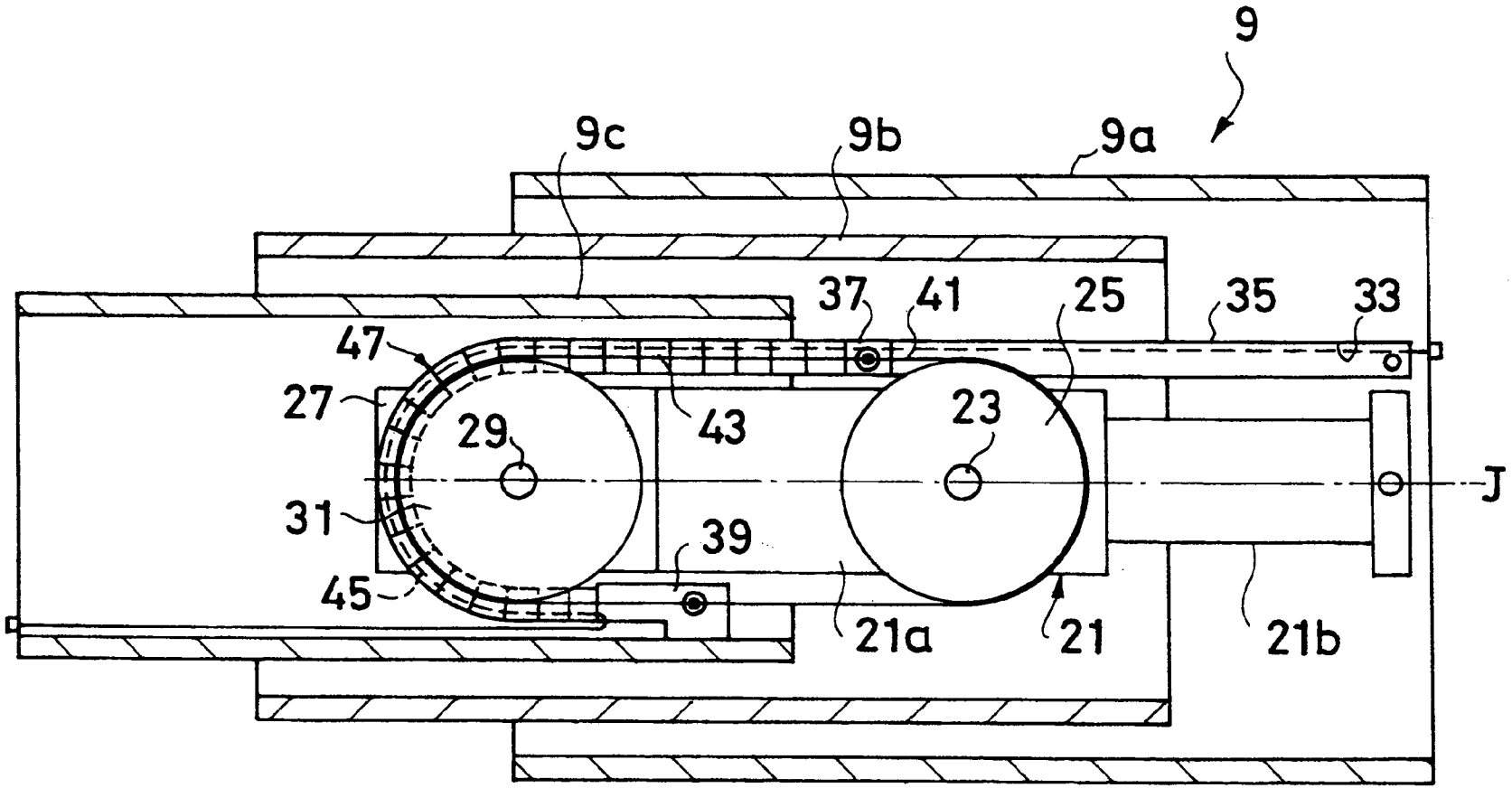
FIG. 5 is a sectional view for explaining operations of the telescopic boom in accordance with the first embodiment.

With reference to FIG. 5, operations of the telescopic boom in accordance with the first embodiment of the present invention will now be explained. For extending the telescopic boom 9 from its retracted state, a hydraulic pressure is supplied to the telescopic cylinder 21 so as to extend the cylinder rod 21*b*. As the cylinder rod 21*b* extends, the cylinder tube 21*a* moves toward the distal end of the telescopic boom 9. Simultaneously therewith, the intermediate boom 9*b* connected to the cylinder tube 21*a* extends. Also, as the cylinder tube 21*a* moves toward the distal end of the telescopic boom 9, the extension wire 43 wound about each extension sheave 31 pulls the distal boom 9*c* toward the distal end of the telescopic boom 9 with the aid of the second wire connecting section 39, thereby extending the distal boom 9*c*.

Also, while the distal boom 9*c* extends when the cylinder tube 21*a* moves toward the distal end of the telescopic boom 9, as the second wire connecting section 39 simultaneously moves toward the distal end of the telescopic boom 9, the flexing position of the protective tube 47 flexed in the vicinity of the distal end portion of the cylinder tube 21*a* moves toward the protective tube 47 connected to the second wire connecting section 39. Hence, even when the distal boom 9*c* extends, the flexing position of the protective tube 47 would move alone without substantially changing its flexing state. Therefore, the hose and the like 45 disposed within the protective tube 47 would not be entangled nor fall apart.

For retracting the telescopic boom 9 from its extended state, on the other hand, the supply of the hydraulic pressure to the telescopic cylinder 21 is reversed. This would retract the cylinder tube 21*a*, thereby retracting the intermediate boom 9*b*. Simultaneously, the retraction wire 41 wound about each retraction sheave 25 pulls back the distal boom 9*c* toward the proximal end of the telescopic boom 9*c* with the aid of the second wire connecting section 39. As a consequence, the distal boom 9*c* is retracted.

Also, while the distal boom 9*c* retracts when the cylinder tube 21*a* moves toward the cylinder rod 21*b*, as the second wire connecting section 39 simultaneously moves toward the proximal end of the telescopic boom 9, the flexing position of the protective tube 47 flexed in the vicinity of the distal end portion of the cylinder tube 21*a* moves toward the protective tube 47 connected to the first wire connecting section 37. Hence, the flexing state would hardly change, whereby the hose and the like 45 disposed within the protective tube 47 would not be entangled nor fall apart.

Second Embodiment

Figure 6:
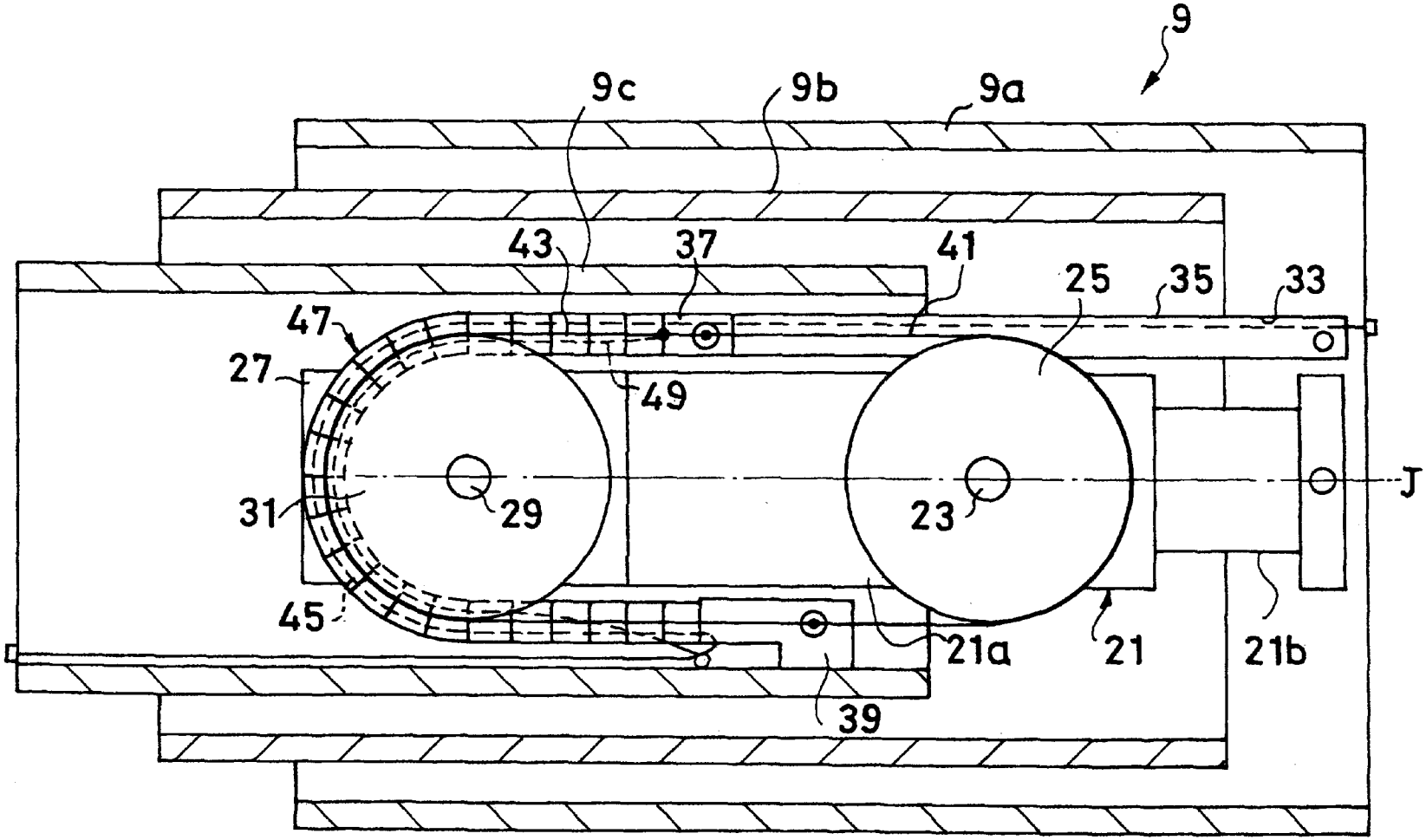
FIG. 6 is a sectional front view of the telescopic boom in accordance with a second embodiment of the present invention.
Figure 7:
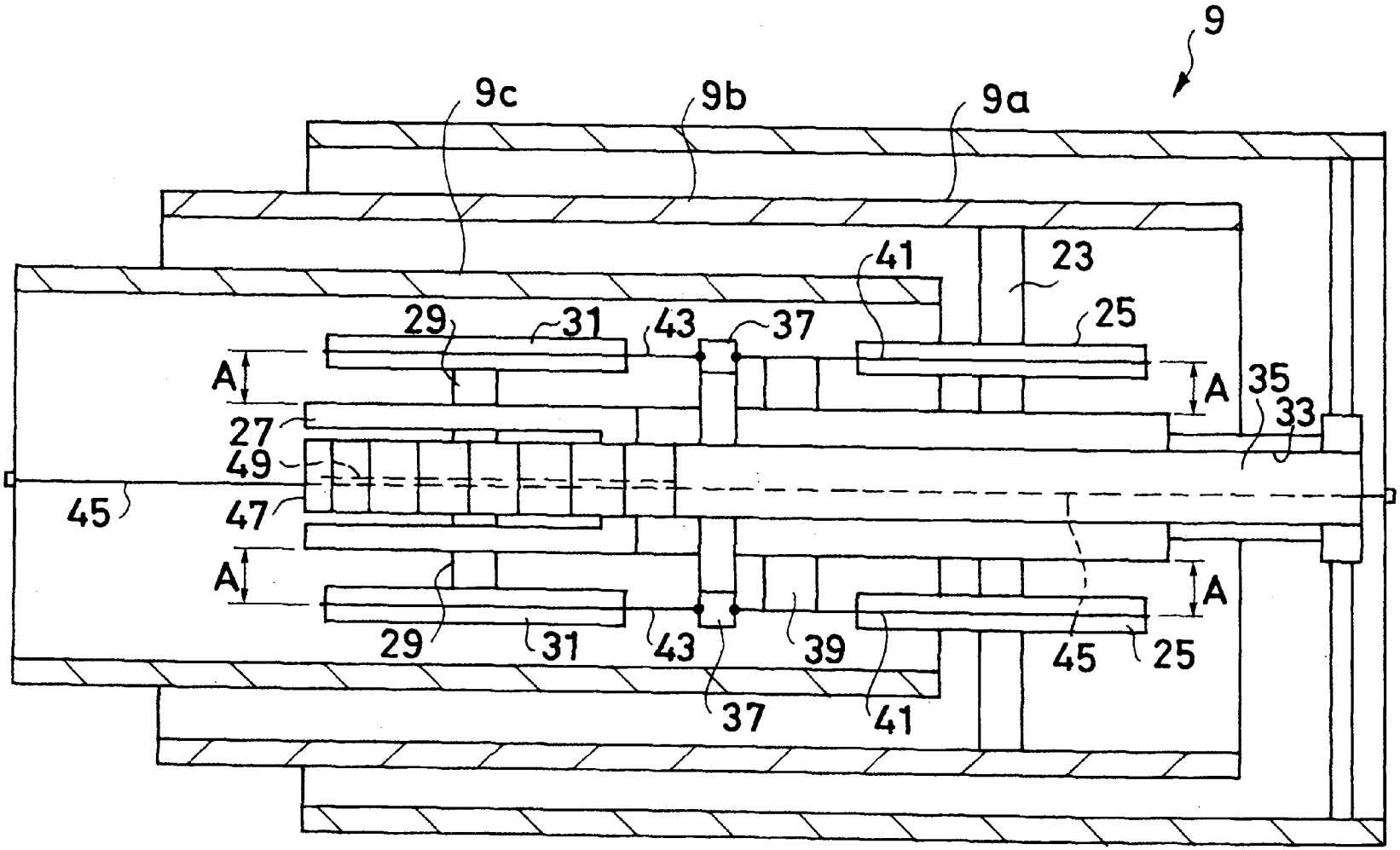
FIG. 7 is a sectional plan view of the telescopic boom in accordance with the second embodiment.

With reference to FIGS. 6 and 7, the second embodiment of the present invention will now be explained. In this embodiment and its subsequent embodiments, only their differences from the first embodiment will be explained, without explaining the constituents identical to those of the first embodiment. These drawings show a subassembly excluding the proximal, intermediate, and distal booms 9*a*, 9*b*, and 9*c*. This subassembly is inserted into and assembled with the boom members 9*a*, 9*b*, and 9*c*. In the telescopic boom in accordance with this embodiment, one end of a drop stopper wire 49 for keeping the distal boom 9*c* from falling down through the telescopic boom 9 is connected to the distal end portion of the guide pipe 35. The drop stopper wire 49 is inserted through the protective tube 47, such that the other end is connected to the proximal end portion of the distal boom 9*c*.

Therefore, in the case where, while the telescopic boom 9 is in an extended state, the extension wire 43 is broken or falls out of the extension sheave 31 such that the distal boom 9*c* falls down through the telescopic boom 9, the end portion of the drop stopper wire 49 connected to the distal boom 9*c* would move down, and the drop stopper wire 49 disposed within the protective tube 47 would project toward the cylinder tube 21*a* so as to be hung on the rotary shaft 29. Thus, the falling movement of the distal boom 9*c* is blocked and stopped by the drop stopper wire 49.

Third Embodiment

Figure 8:
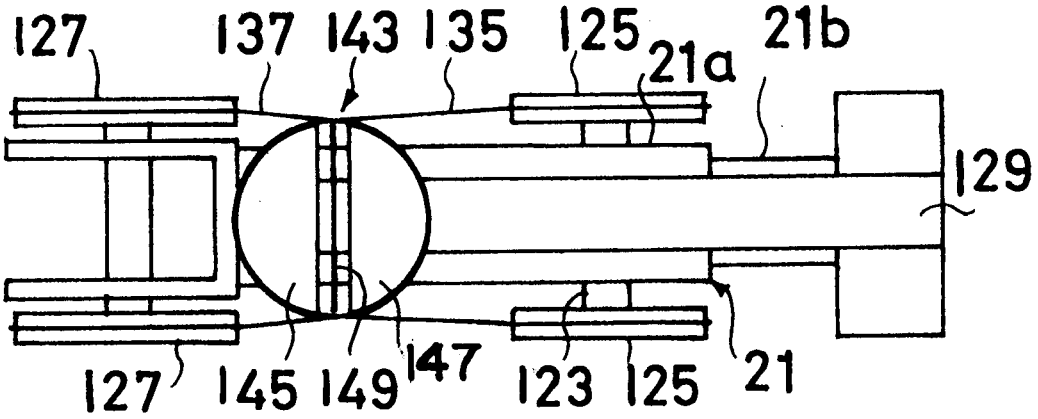
FIGS. 8(*a*) and 8(*b*) are plan and front views showing main parts of the telescopic boom in accordance with a third embodiment of the present invention, respectively.
Figure 8:
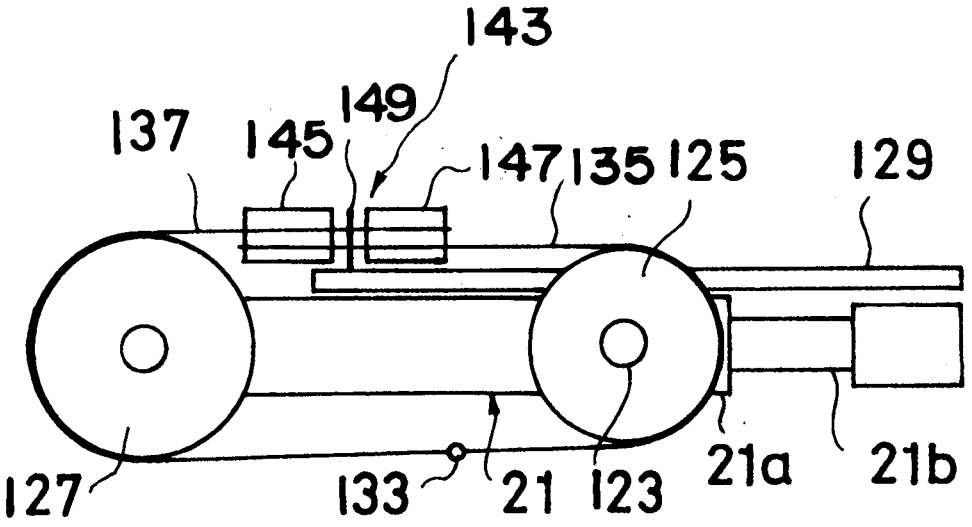

The third embodiment of the present invention will be explained with reference to FIGS. 8(*a*) and 8(*b*) and 9(*a*) to 9(*d*). In the telescopic boom of this embodiment, as shown in FIGS. 8(*a*) and 8(*b*), on the upper side of the distal end of a guide pipe 129, a tension adjuster (extension wire tension adjusting means and retraction wire tension adjusting means) 143 for adjusting tensions of retraction wires 135 and extension wires 137 is disposed between retraction sheaves 125 and extension sheaves 127.

Figure 9:
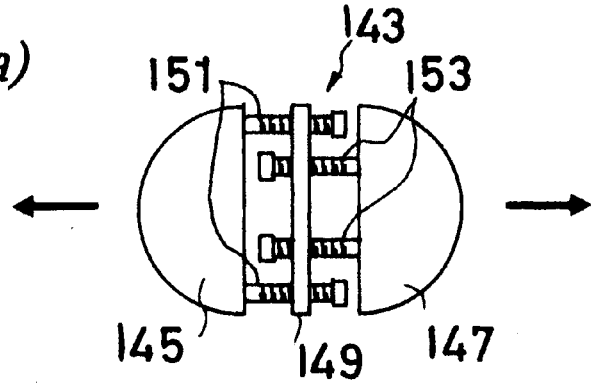
FIGS. 9(*a*) to 9(*d*) are views showing tension adjusters of the telescopic boom in accordance with the third embodiment.
Figure 9:
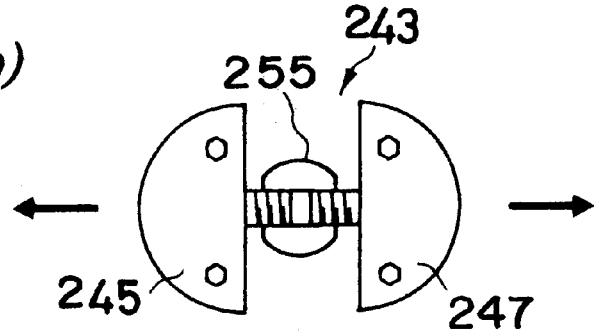
Figure 9:
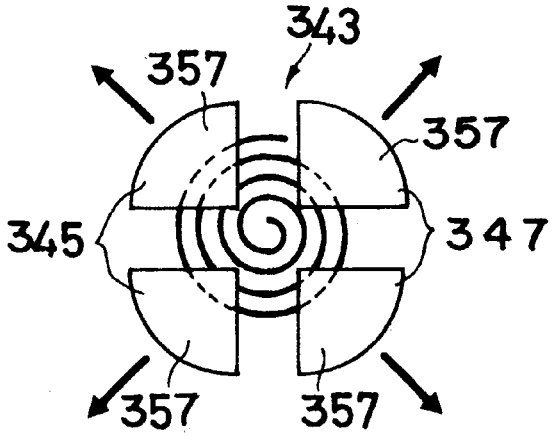
Figure 9:
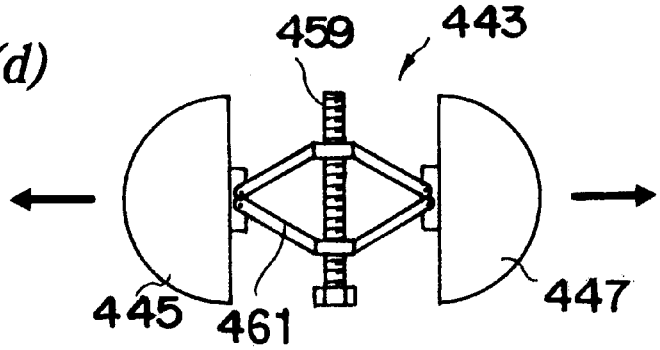

The tension adjuster 143 has a semicircular retraction wire adjusting section 145 for adjusting tensions of the retraction wires 135, a semicircular extension wire tension adjusting section 147, and a fixing plate 149 for securing these sections. Between the retraction wire tension adjusting section 145 and the extension wire tension adjusting section 147, the fixing plate 149 is disposed at a position separated from the inside of each of these sections by a predetermined distance. The lower side of the fixing plate 149 is secured to the upper side of the distal end of the guide pipe 129. As shown in FIG. 9(*a*), the fixing plate 149 engages two retraction wire adjusting screws 151 each having a distal end portion rotatably connected to a wall face of the retraction wire tension adjusting section 145, and two extension wire adjusting screws 153 each having a distal end portion rotatably connected to a wall face of the extension wire tension adjusting section 147. Hence, as the retraction wire adjusting screws 151 or extension wire adjusting screws 153 are rotated, the retraction wire tension adjusting section 145 or the extension wire tension adjusting section 147 moves along the axis of the telescopic boom 9, whereby the tensions of the retraction wires 135 and extension wires 137 can be adjusted.

As the tension adjuster, not only the one shown in FIG. 9(*a*) but also those shown in FIGS. 9(*b*) to 9(*d*) can be used. The tension adjuster 243 shown in FIG. 9(*b*) comprises a so-called turnbuckle 255 having a right-hand thread and a left-hand thread at both ends of the gap between the retraction wire tension adjusting section 245 and the extension wire tension adjusting section 247, respectively. The tension adjuster 343 shown in FIG. 9(*c*) employs a chuck section of a lathe, such that each of its retraction wire tension adjusting section 345 and extension wire tension adjusting section 347 is divided into a pair of sector-shaped movable members 357, which are radially moved, whereby the tensions of the retraction wires 135 and extension wires 137 are adjusted. The tension adjuster 443 shown in FIG. 9(*d*) comprises a jack 461 which extends and retracts as a shaft 459 disposed at the intermediate part of the gap between the retraction wire tension adjusting section 445 and extension wire tension adjusting section 447 is rotated. Effects similar to those of the tension adjuster 143 shown in FIG. 9(*a*) can also be obtained when any of the tension adjusters shown in FIGS. 9(*b*) to 9(*d*) is used.

Fourth Embodiment

Figure 10:
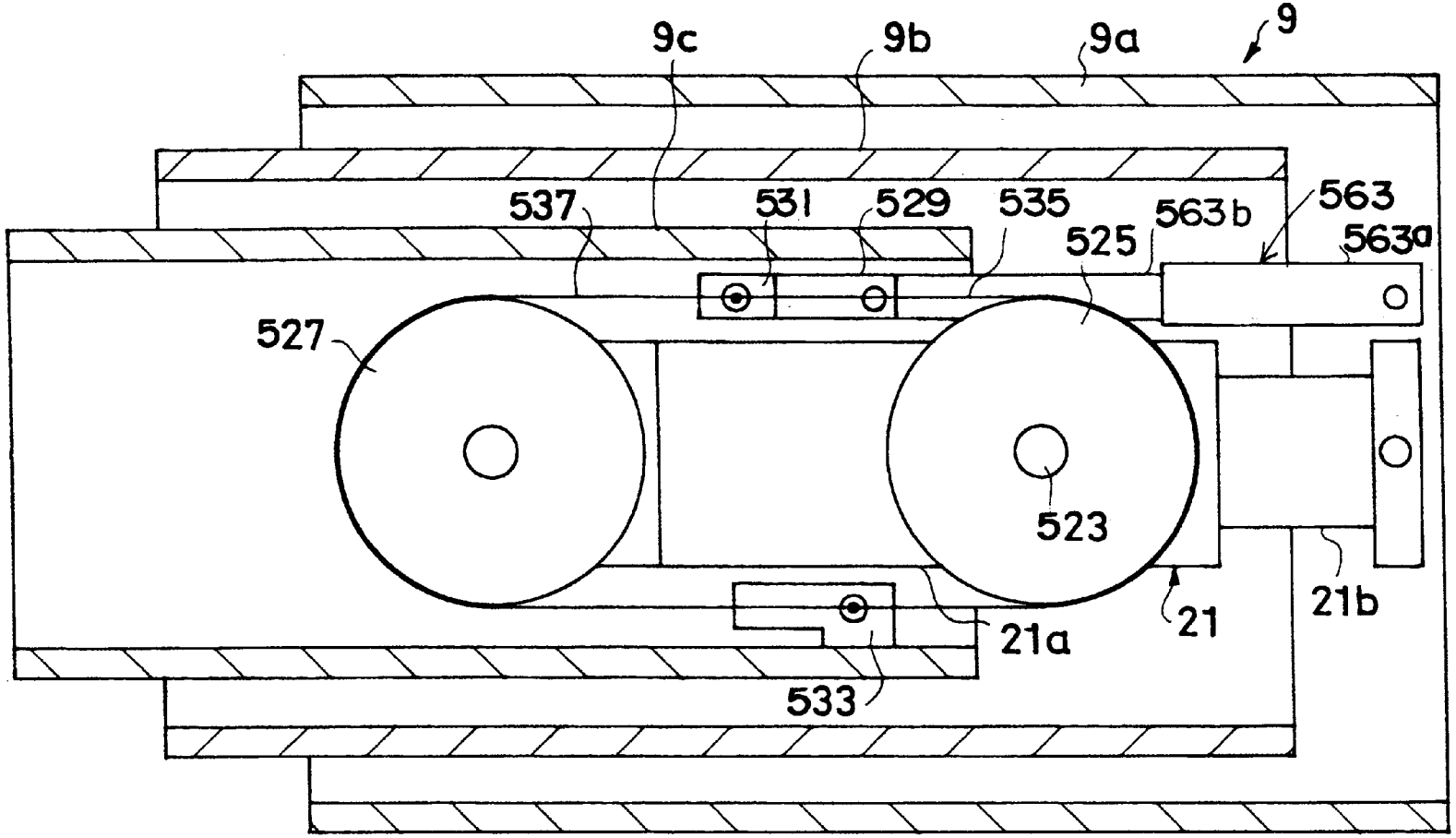
FIG. 10 is a front view of the telescopic boom in accordance with a fourth embodiment of the present invention.

The fourth embodiment of the present invention will now be explained with reference to FIGS. 10 and 11(*a*) to 11(*c*). As shown in FIG. 10, a second telescopic cylinder 563 is disposed within the proximal boom 9*a*, whose cylinder tube 563*a* is fixedly attached to the base part of the proximal boom 563*a*, whereas a distal end portion of the cylinder rod 563*b* of the second telescopic cylinder 563 is fixedly attached to the base part of the guide pipe 529.

Figure 11:
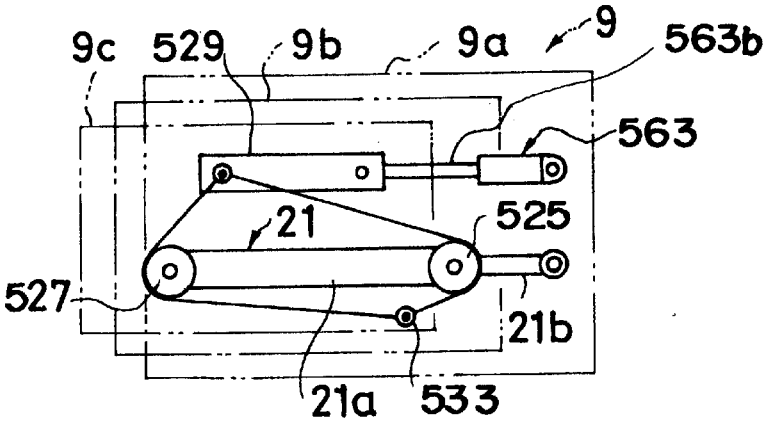
FIGS. 11(*a*) to 11(*c*) are views for explaining actions of the telescopic boom in accordance with the fourth embodiment.
Figure 11:
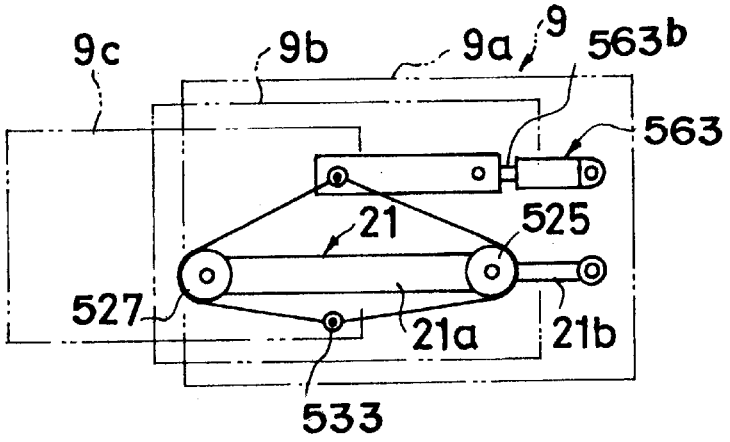
Figure 11:
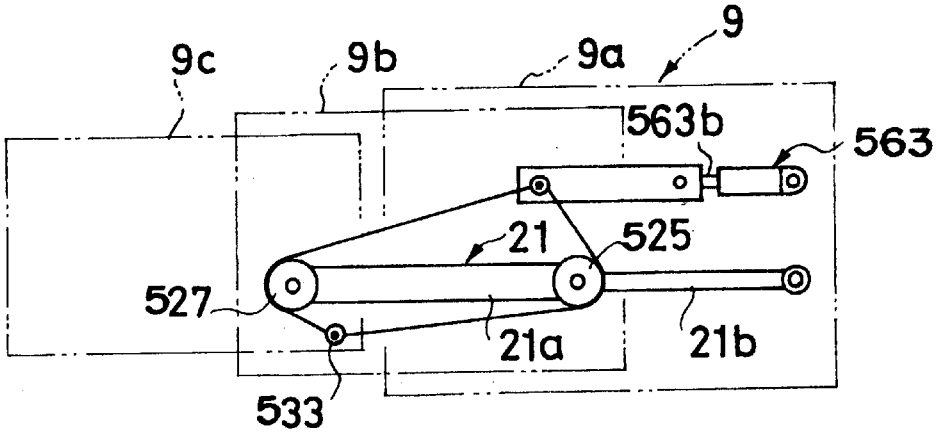

FIGS. 11(*a*) to 11(*c*) are views explaining operations of the telescopic boom 9 in this embodiment. When the second telescopic cylinder 563 is operated so as to retract the cylinder rod 563*b* from the state shown in FIG. 11(*a*) where the telescopic boom 9 is retracted, the extension wire 537 connected to a distal end portion of the guide pipe 529 is pulled toward the base part of the telescopic boom 9, whereby the distal boom 9*c* extends with the aid of the extension sheave 527 and the second wire connecting section 533 as shown in FIGS. 11(*b*) and 11(*c*). Namely, as the second telescopic cylinder 563 is retracted, the distal boom 9*c* can be extended alone. When the telescopic cylinder 521 is extended from the state where only the distal boom 9*c* is extended, the intermediate boom 9*b* and the distal boom 9*c* extend. The extending operation of the intermediate boom 9*b* and distal boom 9*c* is the same as that in the first embodiment.

Fifth Embodiment

The fifth embodiment of the present invention will be explained with reference to FIGS. 12, 13, and so forth. In the telescopic boom of this embodiment, a sheave bracket 625 forming an end member having a predetermined gap is disposed on the distal end side of the telescopic boom 9 from the end part of the cylinder tube 21*a* on the distal end side of the telescopic boom 9. The sheave bracket 625 is provided with a rotary shaft 626 rotatably inserted therethrough in a direction substantially perpendicular to the center axis J of the telescopic cylinder 21. Extension sheaves 627 are axially supported by both end portions of the rotary shaft 626 at positions separated outward from their respective side walls of the sheave bracket 625 by a predetermined distance. Disposed on the upper and lower sides of the end portion of the sheave bracket 625 nearer the telescopic cylinder 21 are flanges 625*a* projecting toward the telescopic cylinder 21.

Figure 14:
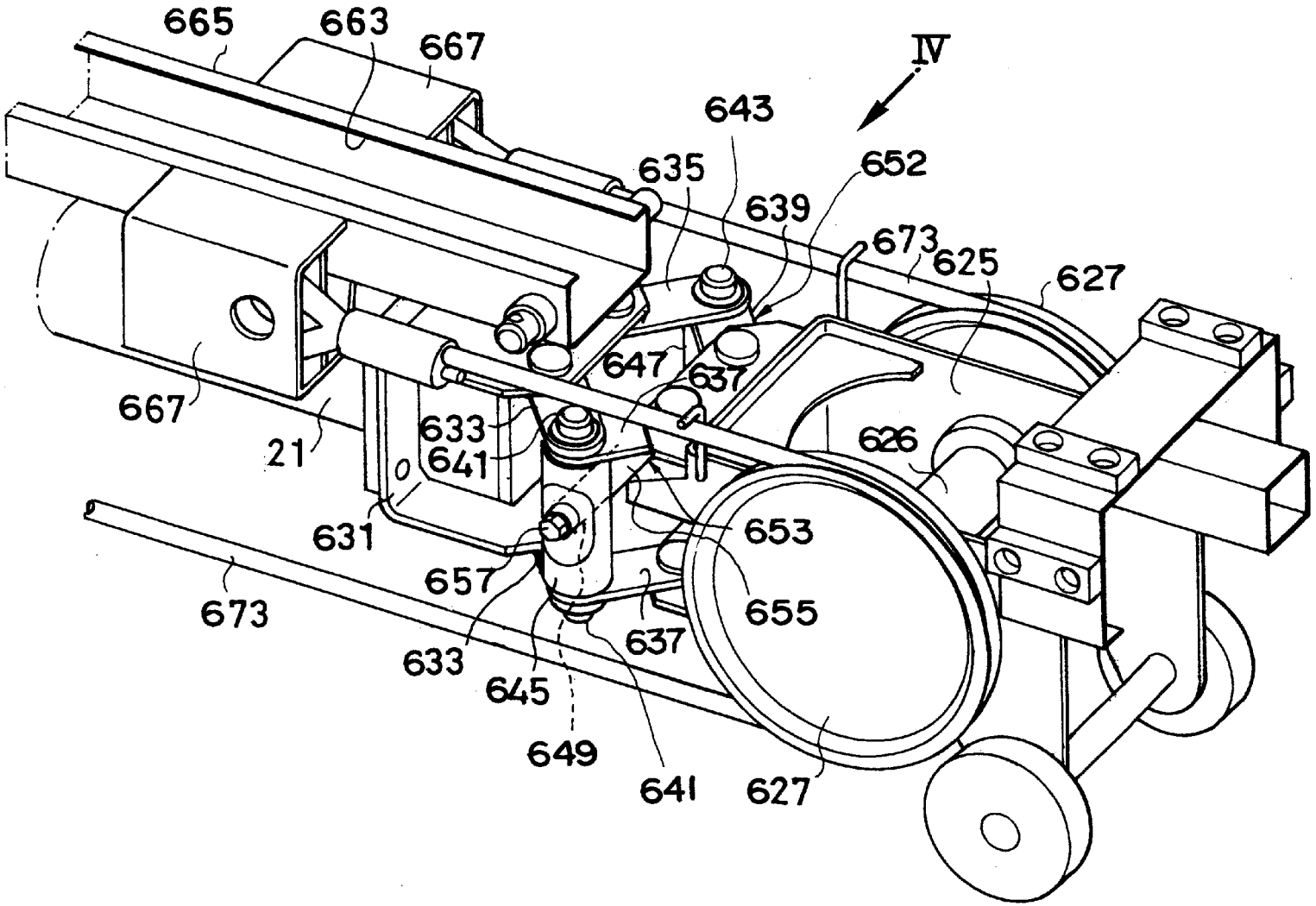
FIGS. 14 and 15 are perspective views showing main parts of the telescopic boom in accordance with the fifth embodiment.
Figure 15:
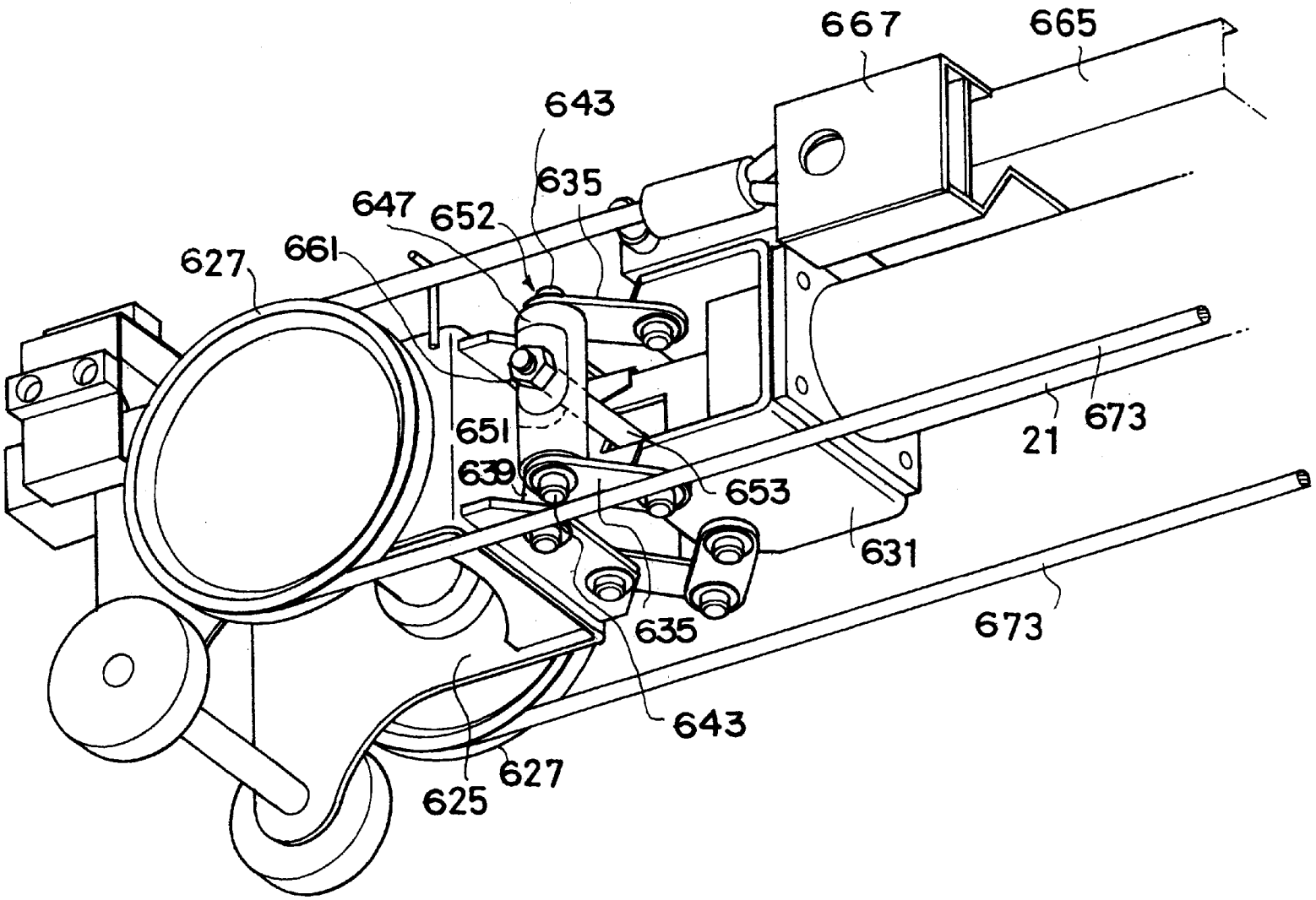

Held between the cylinder tube 21*a* and the sheave bracket 625 is a wire tension adjuster 629 forming an end member moving means. The wire tension adjuster 629 has a link bracket 631 which is connected to the end part of the cylinder tube 21*a* nearer the sheave bracket 625 and has flanges 631*a* projecting toward the sheave bracket 625 on the upper side and lower side thereof. Each flange 631*a* of the link bracket 631 has a first rocking member 633 and a second rocking member 635, each adapted to rock rightward and leftward of the telescopic boom 9, at left and right side portions thereof, respectively. Also, each flange 625*a* of the sheave bracket 625 has a third rocking member 637 and a fourth rocking member 639, each adapted to rock rightward and leftward of the telescopic boom 9, at left and right side portions thereof, respectively. Distal end portions of the first rocking member 633 and third rocking member 634 are pivotally connected to each other via a first pivotal section 641 so as to be able to rock, whereas distal end portions of the second rocking member 635 and fourth rocking member 639 are pivotally connected to each other via a second pivotal section 643 so as to be able to rock. As shown in FIG. 14, a first connecting shaft 645 is disposed between the respective first pivotal sections 641 arranged on the upper and lower sides, such as to connect the first pivotal sections 641 to each other while allowing the distal end portions of the first rocking member 633 and third rocking member 637 to rock. As shown in FIG. 15, a second connecting shaft 647 is disposed between the respective second pivotal sections 643 arranged on the upper and lower sides, such as to connect the first pivotal sections 641 to each other while allowing the distal end portions of the second rocking member 635 and fourth rocking member 639 to rock.

A female screw 649 formed with a left-hand thread penetrates through the center part of the first connecting shaft 645 shown in FIG. 14, in the direction substantially perpendicular to the extending/retracting direction of the telescopic cylinder 21; whereas a female screw 651 formed with a right-hand thread penetrates through the center part of the second connecting shaft 647 shown in FIG. 15, in the direction substantially perpendicular to the extending/retracting direction of the telescopic cylinder 21. As an adjusting shaft 653 engages the female screws 649 and 651, a pantographic link 652 is constituted by the first rocking members 633, second rocking members 635, third rocking members 637, fourth rocking members 639, and adjusting rod 653.

Figure 16:
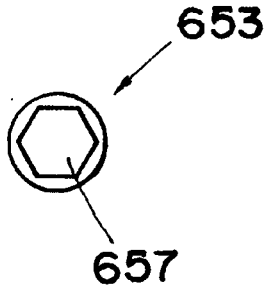
FIGS. 16(*a*) and 16(*b*) are plan and front views showing an adjustment shaft used in the fifth embodiment, respectively.
Figure 16:
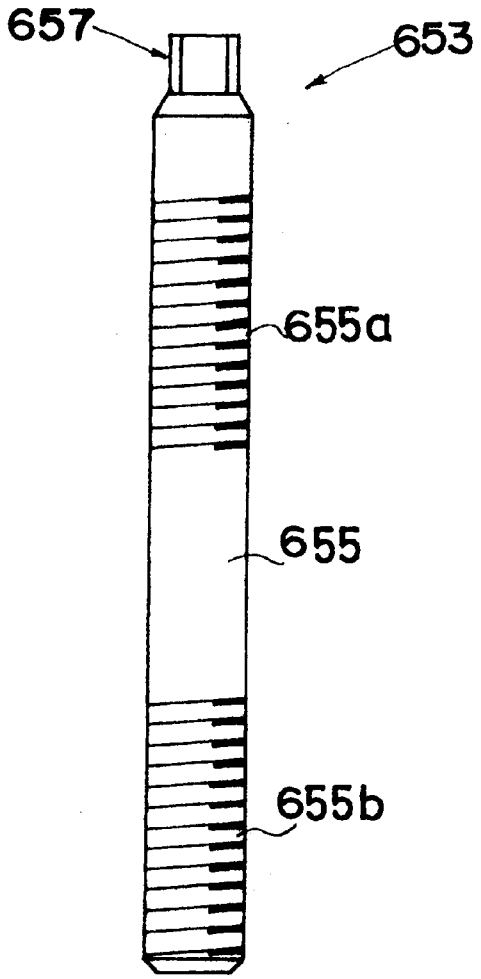

FIGS. 16(*a*) and 16(*b*) show the adjusting shaft 653 and, more specifically, are plan and front views thereof. As shown in FIG. 16(*b*), the adjusting shaft 653 has a main body 655 and a head section 657, the main body 655 is provided with a left-hand thread section 655*a*, nearer the head section 657, formed with a left-hand thread; and a right-hand thread section 655*b*, on the distal end portion side, formed with a right-hand thread. As shown in FIG. 16(*a*), the head section 657 has a hexagonal form, when viewed as a plane, for rotating the adjusting shaft 653.

In the state where the left-hand thread section 655*a* engages the first connecting shaft 654 shown in FIG. 14, while the right-hand thread section 655*b* engages the second connecting shaft 647 shown in FIG. 15, the first connecting shaft 645 and the second connecting shaft 647 would move closer to each other when the adjusting shaft 653 is rotated in one direction (clockwise as viewed from the head section 657 side), whereas they would move away from each other when the adjusting shaft 653 is rotated in the other direction (counterclockwise as viewed from the head section 657 side). Hence, the pantographic link 652 would extend/retract in the same direction as the extending/retracting direction of the telescopic cylinder 21, whereby the link bracket 631 can be moved relative to the telescopic cylinder 21 in the same direction as the extending/retracting direction of the telescopic cylinder 21.

Of the distal end portion of the adjusting axis 653, the part projecting from the second connecting shaft 647 is mounted with a locknut 661 as shown in FIG. 15. As a consequence, if the adjusting shaft 653 is rotated so as to move the second connecting shaft 647 toward the distal end portion of the adjusting shaft 653, the second connecting shaft 647 will abut to the locknut 661, thereby restricting the movement of the second connecting shaft 647. Hence, the telescopic boom 9 shown in FIG. 13 can be prevented from suddenly retracting due to the drop-off of the second connecting shaft 647 from the adjusting shaft 653. Here, the locknut 661 may be disposed on the head section side of the left-hand thread section 655*a*. This can restrict the movement of the first connecting shaft 645, thereby limiting the retracting operation of the pantographic link 652.

Figure 12:
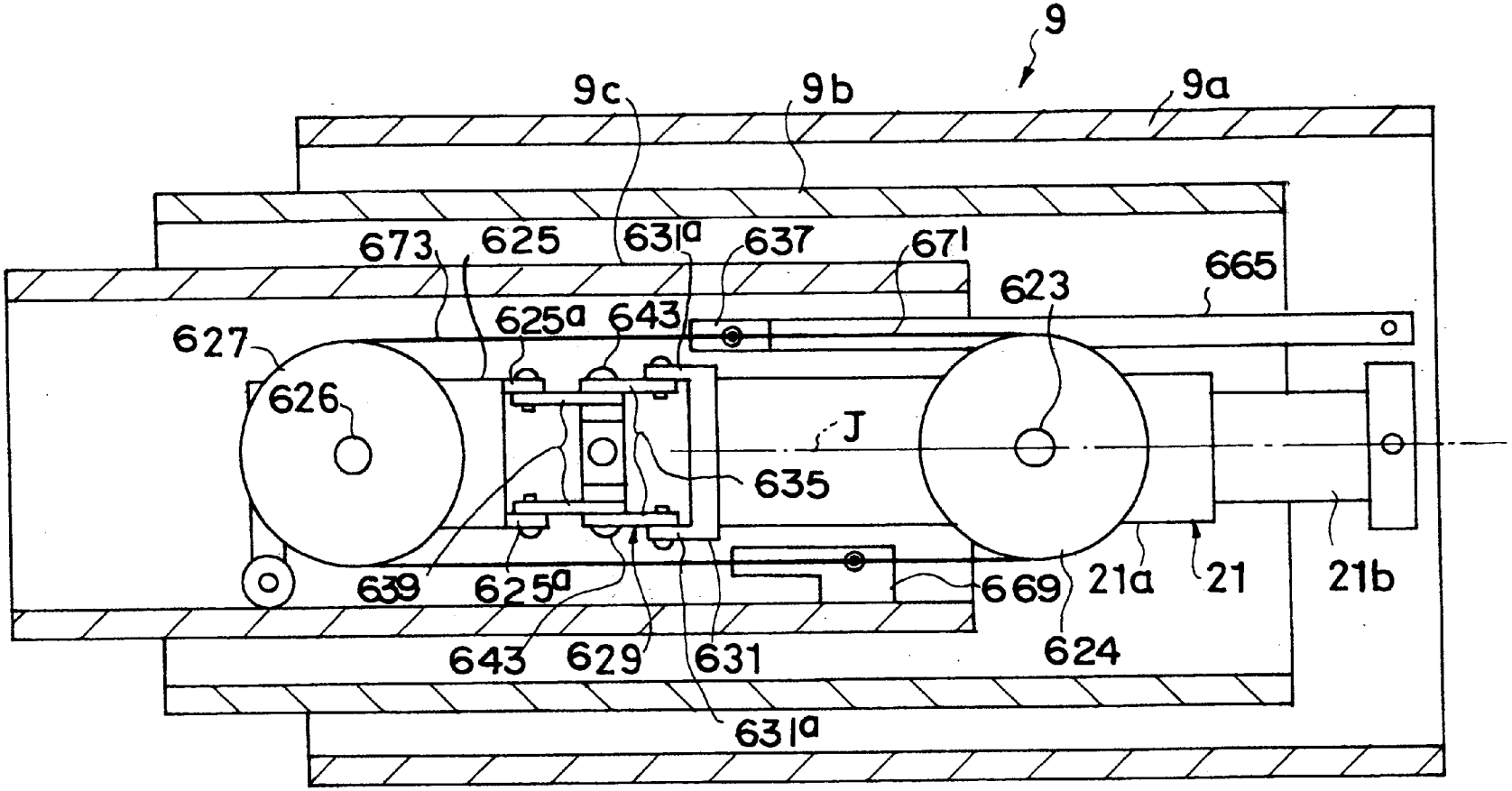
FIG. 12 is a sectional front view of the telescopic boom in accordance with a fifth embodiment of the present invention.
Figure 13:
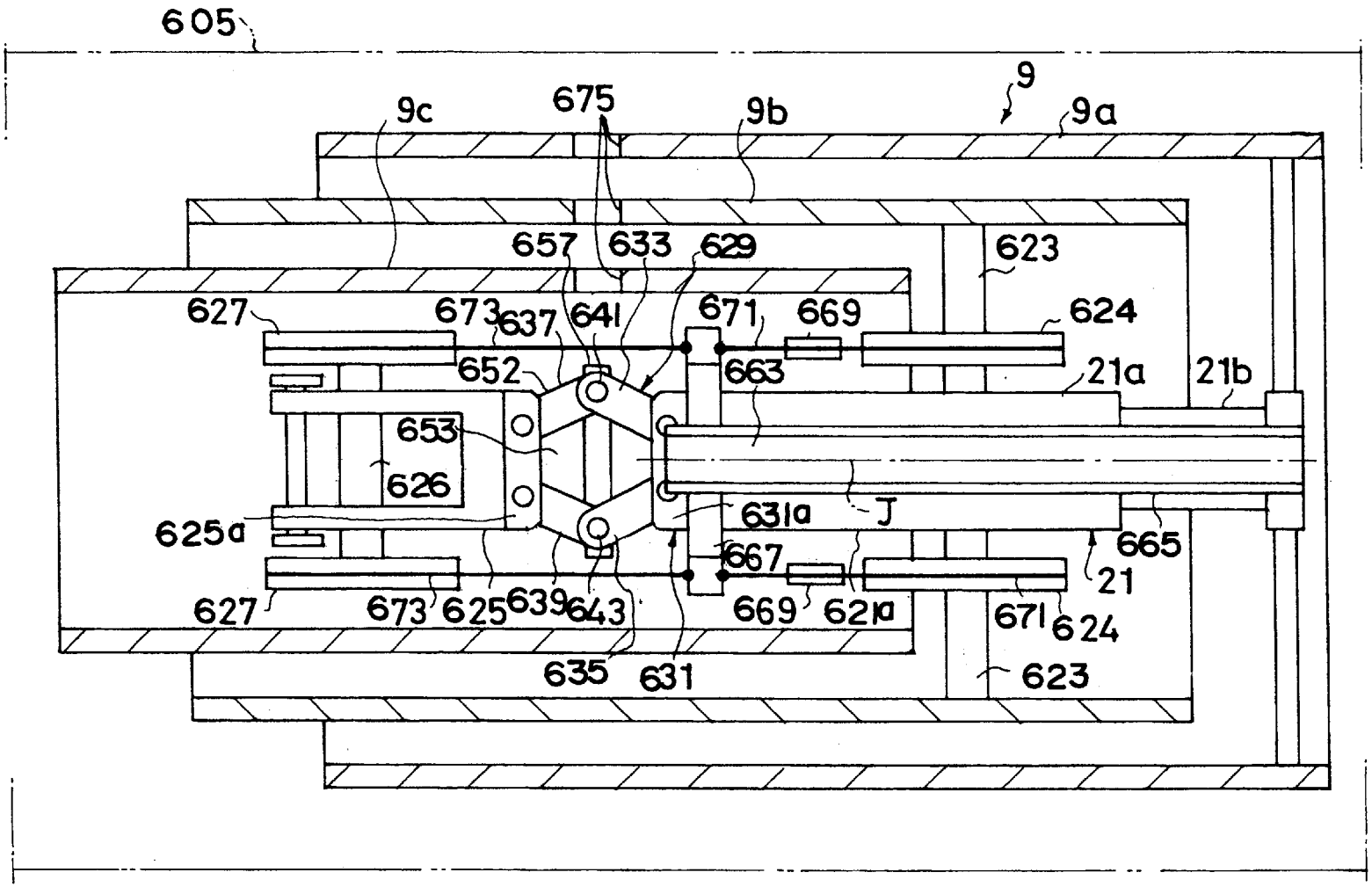
FIG. 13 is a sectional plan view of the telescopic boom in accordance with the fifth embodiment.

As shown in FIGS. 12 and 13, on the upper side of the telescopic cylinder 21, a rod-shaped guide pipe 665 having a hollow groove 663 along the axis J is disposed inside the distal boom 9*c*. The guide pipe 665 has a proximal end portion fixedly attached to the inside of the proximal end portion of the proximal boom 9*a* and a distal end portion disposed between the distal boom 9*c* and the cylinder tube 21*a* and between the retraction sheaves 624 and extension sheaves 627. The distal end portion of the guide pipe 665 is provided with a first wire connecting section 667 laterally projecting rightward and leftward thereof. On the lower side of the cylinder tube 21*a*, at the proximal end portion of the distal end boom 9*c*, a second wire connecting section 669 projecting to the inside of the distal boom 9*c* is disposed.

With one end portion connected to the first wire connecting section 667, a retraction wire 671 is wound about its corresponding retraction sheave 624, so that the other end is connected to the second wire connecting section 669. Also, with one end portion connected to the first wire connecting section 667, an extension wire 673 is wound about its corresponding extension sheave 627, so that the other end is connected to the second wire connecting section 669. More specifically, the retraction wire 671 is wound about the retraction sheave 624 perpendicularly to the stationary shaft 623 thereof, whereas the extension wire 673 is wound about the extension sheave 627 perpendicularly to the rotary shaft 626 thereof. Also, the retraction wire 671 wound about one retraction sheave 624, the retraction wire 671 extending from this retraction sheave 624, the extension wire 673 wound about one extension sheave 627, and the extension wire 673 extending from this extension sheave 627 are stretched within the same plane (within a plane vertical to the paper surface of FIG. 13). As a consequence, the retraction wire 671 wound about one retraction sheave 624, the retraction wire 671 extending from this retraction sheave 624, the extension wire 673 wound about one extension sheave 627, and the extension wire 673 extending from this extension sheave 627 are stretched linearly when viewed on a plane, whereby no thrust loads from the retraction wires 671 and extension wires 673 would act on the retraction sheaves 624 and extension sheaves 627.

As shown in FIG. 13, a through hole 675 for exposing the head section 657 therethrough when the telescopic boom 9 is in its totally retracted state penetrates through the proximal boom 9*a*, intermediate boom 9*b*, and distal boom 9*c* of the telescopic boom 9 each at one side face thereof. As the adjusting shaft 653 is rotated via the head section 657 through thus formed through hole 675, tensions of the extension wires 673 can be adjusted, whereby the efficiency of maintenance operation can be improved. Forming the through hole 675 is not restricted to the state where the telescopic boom 9 is totally retracted but can also be applied to the state where the telescopic boom 9 is extended totally or to a predetermined length. Also, the adjusting shaft 653 may be rotated to adjust the tensions of the retraction wires 671 and the positions of the retraction sheaves 624, guide pipe 665, and second wire connecting section 669, as well as the tensions of the extension wires 673.

Operations of the telescopic boom in accordance with this embodiment will now be explained. First, in the state where the totally retracted telescopic boom 9 shown in FIG. 13 is held on the body 3, an operator inserts a rotating jib (not illustrated) into the through hole 675 such that a distal end portion of the rotating jib engages the head section 657, and then rotates the head section 657 shown in FIG. 14 clockwise with the aid of the rotating jib, whereby the first connecting shaft 645 and the second connecting shaft 647 move closer to each other. Together therewith, the respective distal end portions of the first rocking member 633 and third rocking member 637 rock about the base parts thereof toward the center axis of the telescopic cylinder 21, and the respective distal end portions of the second rocking member 635 and fourth rocking member 639 rock toward the center axis of the telescopic cylinder 21. As a result, the pantographic link 652 is actuated to extend, whereby the sheave bracket 625 moves, relative to the telescopic cylinder 21, toward the distal end portion of the telescopic boom 9 shown in FIG. 13. As the sheave bracket 625 moves toward the distal end portion of the telescopic boom 9, the extension sheaves 627 move toward the distal end portion of the telescopic boom 9. As a consequence, the tensions acting on the two extension wires 673 wound about the respective extension sheaves 627 disposed on the right and left sides of the sheave bracket 625 can be increased at the same time, so as to adjust the tensions of the relaxed extension wires 673. Also, the tensions of the retraction wires 671 and positions of the retraction sheaves 624, guide pipe 665, and second wire connecting section 669 can be adjusted.

When the head section 657 shown in FIG. 14 is rotated counterclockwise with the aid of the rotating jib (not illustrated), then the first connecting shaft 645 and the second connecting shaft 647 move away from each other. Together therewith, the respective distal end portions of the first rocking member 633 and third rocking member 637 rock about the base parts thereof such as to move away from the center axis of the telescopic cylinder 21, and the respective distal end portions of the second rocking member 635 and fourth rocking member 639 rock such as to move away from the center axis of the telescopic cylinder 21. As a result, the pantographic link 652 is actuated to retract, whereby the sheave bracket 625 relatively moves toward the telescopic cylinder 21. As the extension sheaves 627 thus relatively move toward the telescopic cylinder 21, the tensions acting on the extension wires 673 can be reduced, so as to adjust the tensions of the stretched extension wires 673. Also, the tensions of the retraction wires 671 and positions of the retraction sheaves 624, guide pipe 665, and second wire connecting section 669 can be adjusted.

In this embodiment, the first connecting shaft 645 is made of a female screw formed with a left-hand thread, the second connecting shaft 647 is a female screw formed with a right-hand thread, and the adjusting shaft 653 is adapted to engage them. Without being restricted thereto, screws opposite thereto may also be used. Also, the telescopic boom 9 may be constructed without the retraction sheaves 624 and retraction wires 671. In thus configured telescopic boom 9, the wire tension adjuster 629 can be disposed between the cylinder tube 21*a* and the sheave bracket 625 and actuated so as to adjust the tensions of extension wires 673. Further, though the wire tension adjuster 629 is disposed between the cylinder tube 21*a* and the sheave bracket 625, it can be disposed between the retraction sheaves 624 and the cylinder rod 21*b* so as to adjust the tensions of retraction wires 671.

Sixth Embodiment

Figure 17:
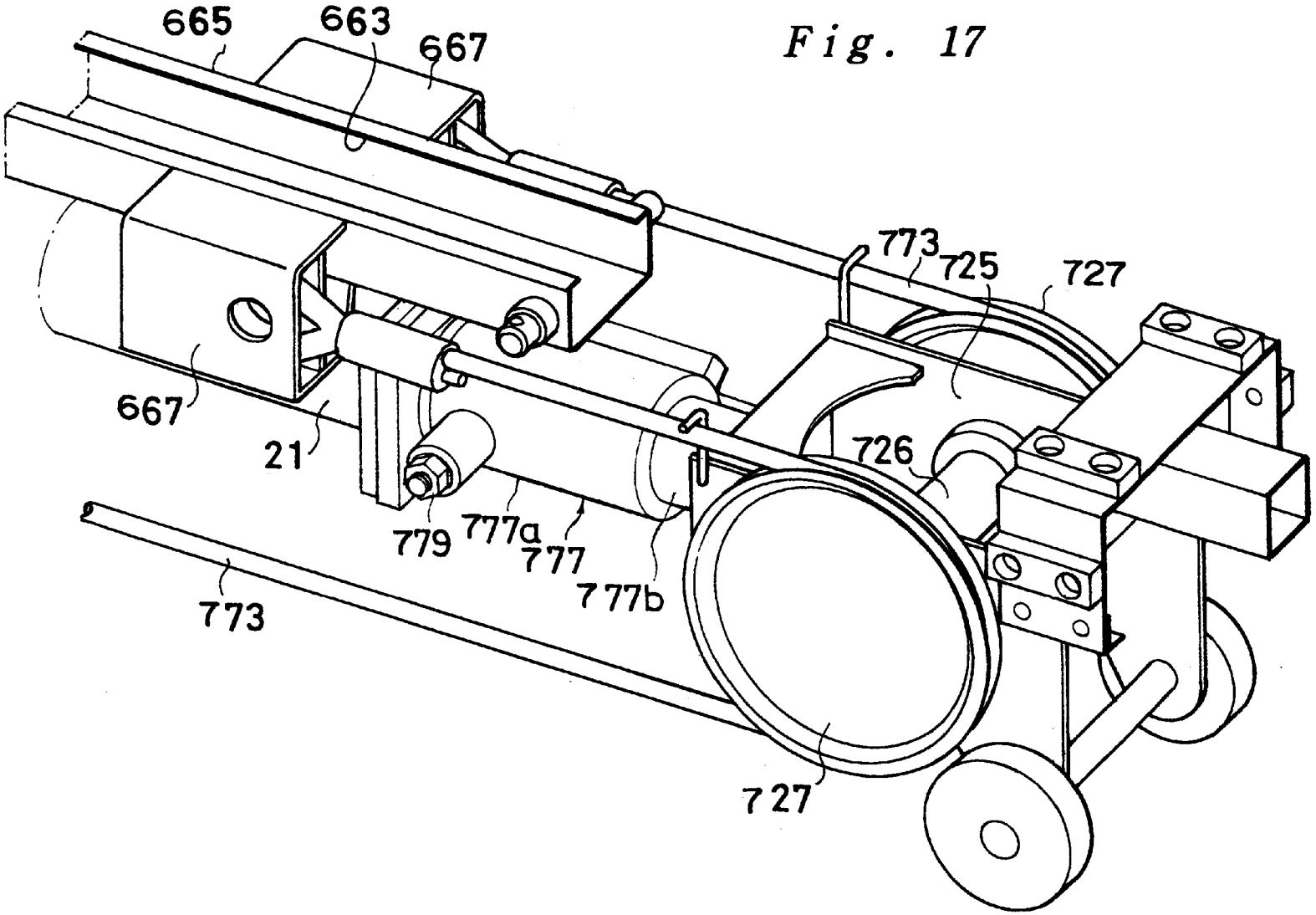
FIGS. 17 and 18 are perspective views showing main parts of the telescopic boom in accordance with a sixth embodiment of the present invention.

The sixth embodiment of the present invention will now be explained with reference to FIGS. 17 and 18. In the following, constituents identical to those of the fifth embodiment will be referred to with the numerals identical thereto, without repeating their explanations. In this embodiment, as shown in FIG. 17, a grease cylinder 777 is disposed between the sheave bracket 725 and the telescopic cylinder 21. The grease cylinder 777 has a cylinder tube 777*a* and a rod 777*b*, such that the rod 777*b* can plunge into and out of the cylinder tube 777*a*. A distal end portion of the rod 777*b* is connected to the end part of the sheave bracket 725, whereas the end part of the cylinder tube 777*a* is connected to the end part of the telescopic cylinder 21 nearer the sheave bracket 725. The side wall of the cylinder tube 777*a* on the front side nearer the telescopic cylinder 21 is provided with a grease nipple 779 which acts as an inlet for injecting grease into the cylinder tube 777*a*. The grease nipple 779 incorporates therein a not-illustrated check valve, thus being capable of keeping the injected grease from flowing back, whereby the amount of extension of the rod 777*b* can be controlled by the amount of injection of the grease. A not-illustrated tube is connected to the grease nipple 779, and the other end of the tube is guided outside the telescopic boom 9 shown in FIG. 12.

Figure 18:
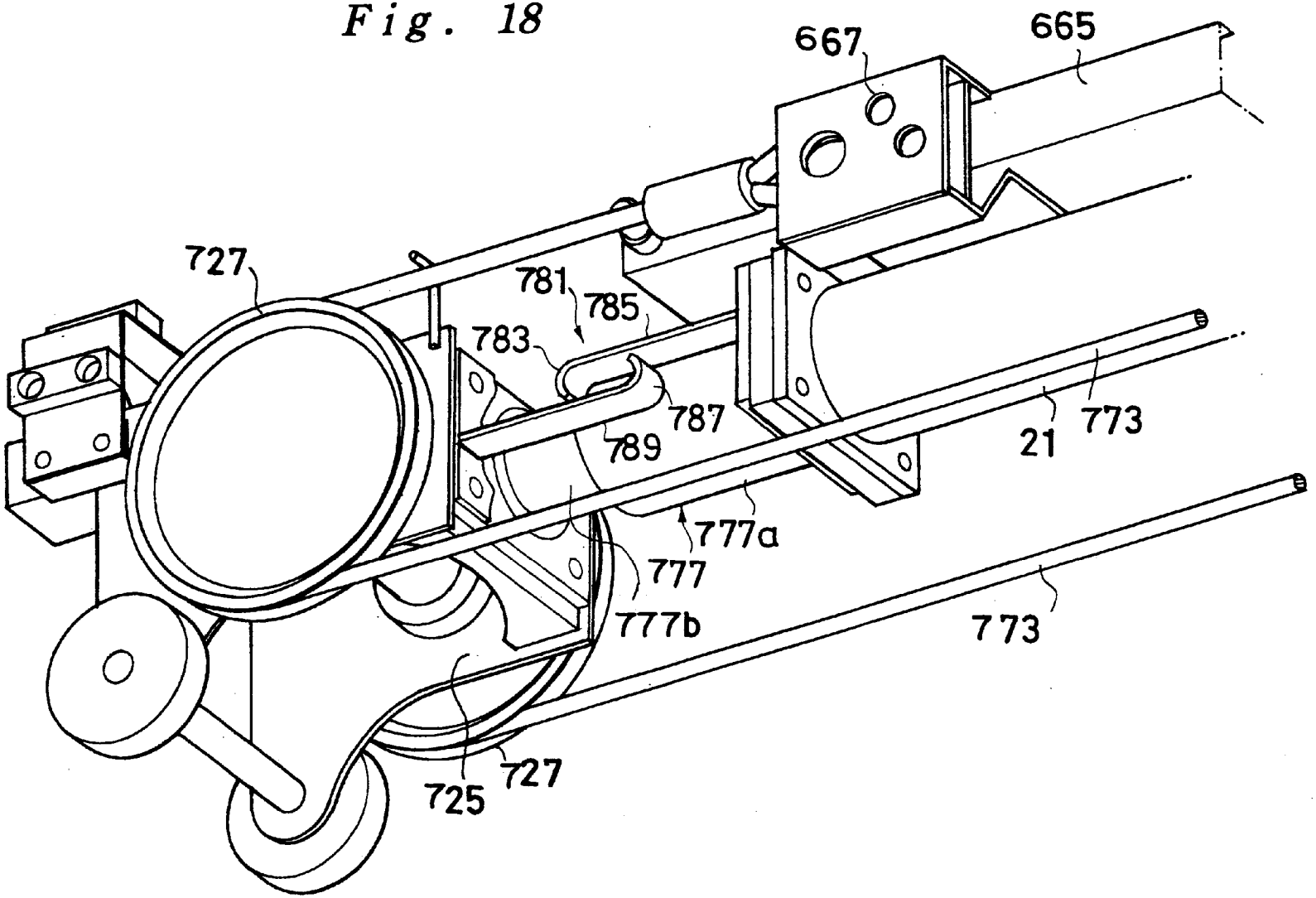
Figure 19:
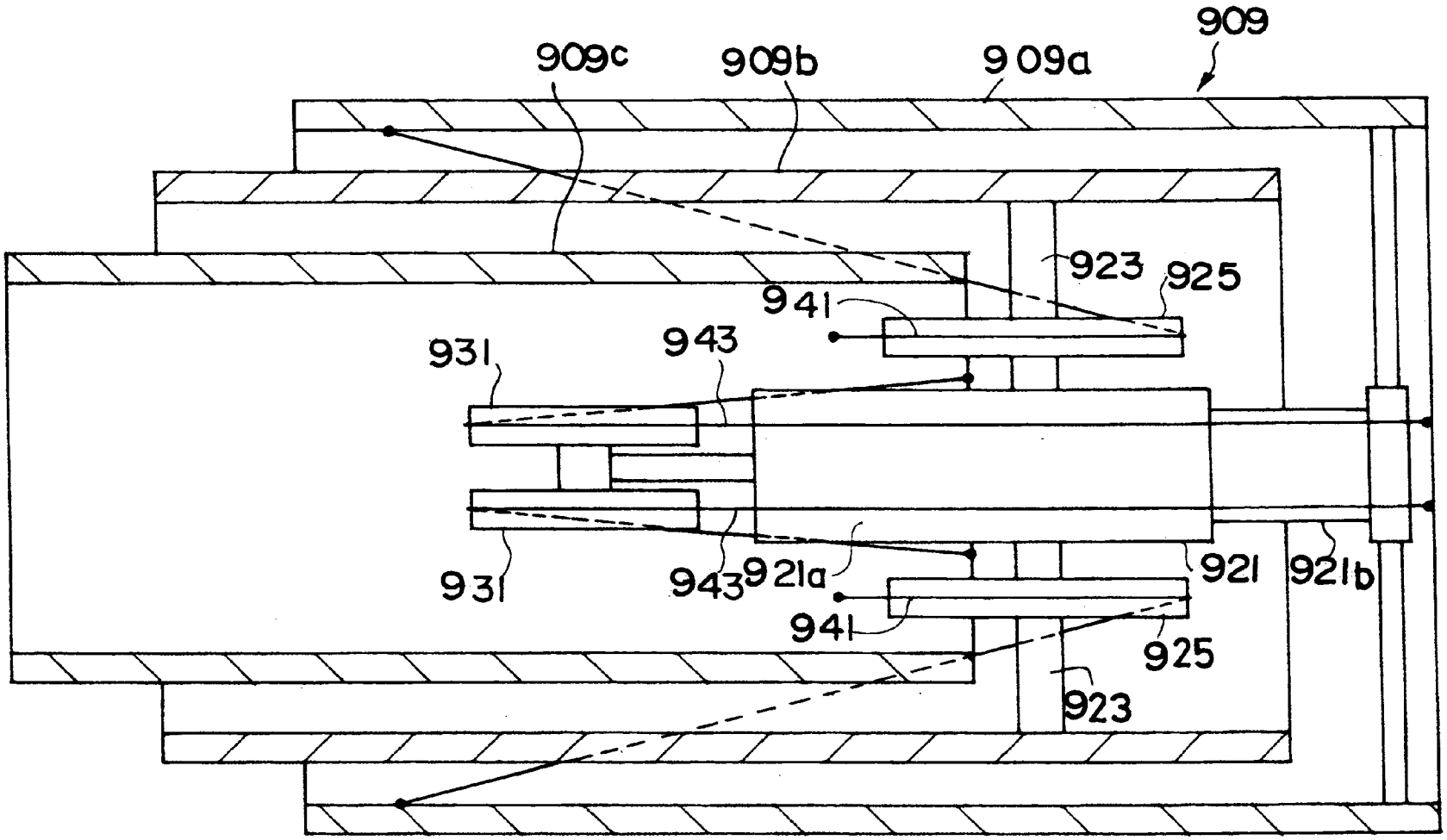
FIGS. 19 and 20 are views showing a conventional telescopic boom.
Figure 20:
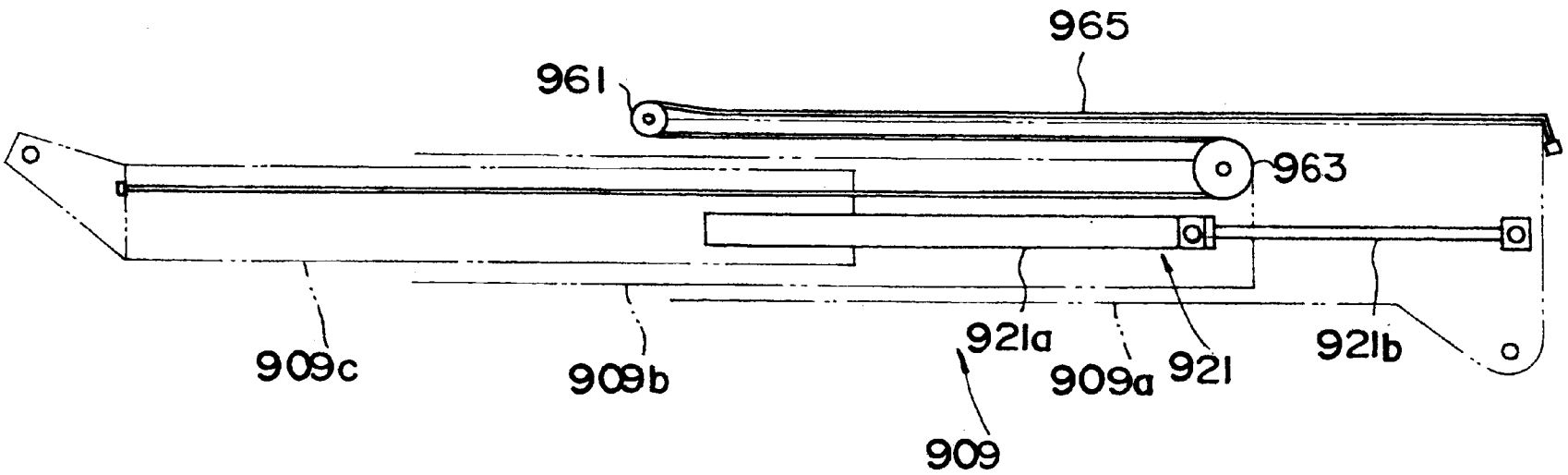

Also, as shown in FIG. 18, an extension regulator 781 for keeping the amount of extension of the grease cylinder 777 from becoming greater than a predetermined amount is disposed outside the side wall of the cylinder tube 777*a* of the grease cylinder 777 on the inner side. The extension regulator 781 comprises a first engagement means 785 having a first engagement section 783 which projects from the end part of the cylinder tube 777*a* nearer the telescopic cylinder 21 toward the sheave bracket 725 with its distal end portion curved downward, and a second engagement means 789 having a second engagement section 787 projecting from the end part of the sheave bracket 725 nearer the telescopic cylinder 21 toward the telescopic cylinder 21 with its distal end portion curved upward. When the rod 777*b* extends such that the amount of extension of the grease cylinder becomes a predetermined amount or over, then the first engagement section 783 and the second engagement section 789 abut to each other, whereby the extending operation of the rod 777*b* is restricted, so that the rod 777*b* is kept from dropping out of the cylinder tube 777*a*, whereby the telescopic boom 9 shown in FIG. 12 can be prevented from suddenly retracting.

As the grease cylinder 777 is disposed between the telescopic cylinder 21 and the sheave bracket 725 and operated to extend, the tensions of relaxed extension wires 773 can be increased. Also, in such a simple configuration, the tensions of two extension wires 773 wound about the two respective extension sheaves 727 disposed on the right and left sides can be adjusted simultaneously and easily. Further, as a tube is connected to the grease nipple 779 and the other end of the tube is guided outside the extension boom 9, the grease can easily be injected into the grease cylinder 777.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A telescopic boom comprising a first boom, a second boom inserted into said first boom so as to be able to extend and retract therein, and a third boom inserted into said second boom so as to be able to extend and retract therein, which are assembled together in a telescopic fashion, said telescopic boom further comprising:

a telescopic cylinder, adapted to plunge into and out of said third boom, having a cylinder rod with a distal end portion fixedly attached to an inner proximal end portion of said first boom and a cylinder body fixedly attached to an inner proximal end portion of said second boom;

a retraction sheave disposed aside of said telescopic cylinder nearer a proximal end portion thereof;

an extension sheave disposed aside of said telescopic cylinder nearer a distal end portion thereof;

a hollow rod member, disposed on an upper or lower side of said telescopic cylinder, having one end fixedly attached to a proximal end portion of said first boom and the other end extending between said retraction sheave and said extension sheave;

a retraction wire, wound about said retraction sheave, having one end fixedly attached to a distal end portion of said rod member and the other end fixedly attached to a proximal end portion of said third boom;

an extension wire, wound about said extension sheave, having one end fixedly attached to the distal end portion of said rod member and the other end fixedly attached to the proximal end portion of said third boom;

flexible, tubular, hydraulic/electric feed protecting means having one end fixedly attached to the distal end portion of said rod member in communication therewith, extending toward said distal end portion, being reversed in the vicinity of an end portion of said cylinder body to provide a rolling bite, and extending toward the proximal end portion of said telescopic boom at a position opposing said rod member across said cylinder body, so as to connect with the proximal end portion of said third boom; and hydraulic/electric feed means extending from the proximal end side of said first boom through said hollow rod member and said flexible, tubular hydraulic/electric feed protecting means communicating therewith.

2. A telescopic boom according to claim 1, wherein said retraction wire in a state wound around said retraction sheave and said extension wire in a state wound around said extension sheave are disposed within an identical plane.

3. A telescopic boom according to claim 1, wherein the distal end portion of said rod member positioned between said extension sheave and said retraction sheave is provided with retraction wire tension adjusting means for adjusting a tension of said retraction wire and extension wire tension adjusting means for adjusting a tension of said extension wire.

4. A telescopic boom according to claim 3, wherein said retraction wire tension adjusting means has a retraction wire adjusting member axially movably disposed at the distal end of said rod member, said extension wire tension adjusting means has an extension wire adjusting member movably disposed at the distal end of said rod member, and said retraction wire adjusting member and said extension wire adjusting member are axially moved relative to the distal end of said rod member so as to adjust the tensions of said retraction wire and extension wire.

5. A telescopic boom according to claim 4, wherein:

a pair of said retraction sheaves are disposed on right and left sides of said telescopic cylinder nearer the proximal end portion, respectively, whereas a pair of said extension sheaves are disposed on right and left sides of said telescopic cylinder nearer the distal end portion, respectively;

end portions of said retraction wires respectively wound about said retraction sheaves and extending from upper parts of said retraction sheaves are connected to each other, thus connected retraction wire being wound about said retraction wire adjusting member, said retraction wire adjusting member being axially moved to adjust the tension of said retraction wire; and end portions of said extension wires respectively wound about said extension sheaves and extending from upper parts of said extension sheaves are connected to each other, thus connected extension wire being wound about said extension wire adjusting member, said extension wire adjusting member being axially moved to adjust the tension of said extension wire.

6. A telescopic boom according to any of claims 1 to 5, wherein said rod member includes a second telescopic cylinder, said second telescopic cylinder being extended or retracted to axially move the proximal end portion of said rod member, so as to allow said third boom to independently extend or retract alone.

7. A telescopic boom comprising a first boom mounted to a vehicle so as to be able to derrick and swivel, a second boom inserted into said first boom so as to be able to extend and retract therein, and a third boom inserted into said second boom so as to be able to extend and retract therein, which are assembled together in a telescopic fashion, said telescopic boom further comprising:

a telescopic cylinder, adapted to plunge into and out of said third boom, having a cylinder rod with a distal end portion fixedly attached to an inner proximal end portion of said first boom and a cylinder body fixedly attached to an inner proximal end portion of said second boom;

a retraction sheave disposed aside of said telescopic cylinder nearer a proximal end portion thereof;

an extension sheave disposed aside of said telescopic cylinder nearer a distal end portion thereof;

a hollow rod member, disposed on an upper or lower side of said telescopic cylinder, having one end fixedly attached to a proximal end portion of said first boom and the other end extending between said retraction sheave and said extension sheave;

a retraction wire, wound about said retraction sheave, having one end fixedly attached to a distal end portion of said rod member and the other end fixedly attached to a proximal end portion of said third boom;

an extension wire, wound about said extension sheave, having one end fixedly attached to the distal end portion of said rod member and the other end fixedly attached to the proximal end portion of said third boom;

flexible, tubular, hydraulic/electric feed protecting means having one end fixedly attached to the distal end portion of said rod member in communication therewith, extending toward said distal end portion, being reversed in the vicinity of an end portion of said cylinder body to provide a rolling bite, and extending toward the proximal end portion of said telescopic boom at a position opposing said rod member across said cylinder body, so as to connect with the proximal end portion of said third boom; and hydraulic/electric feed means extending from the proximal end side of said first boom through said hollow rod member and said flexible, tubular hydraulic/electric feed protecting means communicating therewith.

8. A telescopic boom according to claim 7, further comprising a drop stopper wire having one end connected to the distal end portion of said hollow rod member, extending toward the distal end of said telescopic boom, being reversed in the vicinity of an end portion of said cylinder body, and extending toward the proximal end portion of said telescopic boom at a position opposing said hollow rod member across said cylinder body so as to connect with said proximal end portion of said third boom.

9. A telescopic boom according to claim 8, wherein said cylinder body is provided with a rotary shaft inserted through said telescopic boom rightward and leftward on the distal end side and projecting outside right and left side walls of said cylinder body, and wherein, when at least the part of said rotary shaft nearer to the distal end thereof than is an intermediate portion thereof is exposed such that said extension sheave is axially supported by both end portions of said rotary shaft and said third boom is moved toward the proximal end of said telescopic cylinder, said drop stopper wire is hung on the intermediate portion of said exposed rotary shaft, such that said third boom is stopped and held within said telescopic boom.

10. A telescopic boom comprising a first boom, a second boom inserted into said first boom so as to be able to extend and retract therein, and a third boom inserted into said second boom so as to be able to extend and retract therein, which are assembled together in a telescopic fashion, said telescopic boom further comprising:

a telescopic cylinder, adapted to plunge into and out of said third boom, having a cylinder rod with a distal end portion fixedly attached to an inner proximal end portion of said first boom and a cylinder body fixedly attached to an inner proximal end portion of said second boom;

an end member mounted to said telescopic cylinder nearer a distal end portion of said telescopic cylinder;

a retraction sheave disposed aside of said telescopic cylinder;

an extension sheave disposed aside of said end member;

a hollow rod member, disposed on an upper or lower side of said telescopic cylinder, having one end fixedly attached to a proximal end portion of said first boom and the other end extending between said retraction sheave and said extension sheave;

a retraction wire, wound about said retraction sheave, having one end fixedly attached to a distal end portion of said hollow rod member and the other end fixedly attached to a proximal end portion of said third boom;

an extension wire, wound about said extension sheave, having one end fixedly attached to the distal end portion of said hollow rod member and the other end connected to said third boom;

end member moving means, disposed between said cylinder body and said table, for moving said end member relative to said cylinder body in a direction identical to an extending/retracting direction of said telescopic cylinder;

flexible hydraulic/electric feed protecting means having one end fixedly attached to the distal end portion of said hollow rod member in communication therewith, extending toward said distal end portion, being reversed in the vicinity of an end portion of said cylinder body to provide a rolling bite, and extending toward the proximal end portion of said telescopic boom at a position opposing said hollow rod member across said cylinder body, so as to connect with the proximal end portion of said third boom; and hydraulic/electric feed means extending from the proximal end side of said first boom through said hollow rod member and said flexible hydraulic/electric feed protecting means communicating therewith.

11. A telescopic boom according to claim 10, wherein said end member is moved by said end member moving means relative to said cylinder body in the direction identical to the extending/retracting direction of said telescopic cylinder, so as to adjust a tension of at least one of said extension wire wound about said extension sheave and said retraction wire wound about said retraction sheave.

12. A telescopic boom according to claim 10, wherein said end member moving means is a pantographic link comprising first and second rocking members disposed at the end portion of said telescopic cylinder on the distal end side so as to be able to rock rightward and leftward; a third rocking member pivotally connected to a distal end portion of said first rocking member so as to be able to move together therewith by way of a first pivotal section which is disposed at the end of said end member on the proximal end side so as to be able to rock rightward and leftward; a fourth rocking member pivotally connected to a distal end portion of said second rocking member so as to be able to move together therewith by way of a second pivotal section which is disposed at the end of said table on the proximal end side so as to be able to rock rightward and leftward; and distance adjusting means for adjusting a distance between said first pivotal section and said second pivotal section.

13. A telescopic boom according to claim 12, wherein said first pivotal section has a female screw formed with a left-hand thread or right-hand thread, said second pivotal section has a female screw formed with a right-hand thread or left-hand thread, said distance adjusting means has an adjusting shaft engaging said female screws, one end of said adjusting shaft has a first thread section formed with a left-hand thread or right-hand thread adapted to engage said female screw of said first pivotal section, the other end of said adjusting shaft has a second thread section formed with a right-hand thread or left-hand thread adapted to engage said female screw of said second pivotal section, one end portion of said adjusting shaft has a shaft-rotating section for rotating said adjusting shaft, and the other end portion of said adjusting shaft has a locknut for keeping said first and second pivotal sections from dropping out of said adjusting shaft.

14. A telescopic boom according to claim 10, wherein said end member moving means is a grease cylinder, a distal end portion of a rod section of said grease cylinder is connected to one of the end portion of said telescopic cylinder on the distal end side or the end portion of said end member on its base side, whereas a bottom portion of a bottom section of said grease cylinder is connected to the other of the end portion of said telescopic cylinder on the distal end side or the end portion of said end member on its base side.

* * * * *